US006233895B1

(12) United States Patent
Evans et al.

(10) Patent No.: US 6,233,895 B1
(45) Date of Patent: May 22, 2001

(54) LIGHT-WEIGHT, REINFORCED, EXTRUDED ROOFING TILE

(75) Inventors: Lewis M. Evans, Salt Lake City; Michael M. Evans, Centerville, both of UT (US)

(73) Assignee: Evans Brothers Investments, Centerville, UT (US)

( * ) Notice: Subject to any disclaimer, the term of this patent is extended or adjusted under 35 U.S.C. 154(b) by 0 days.

(21) Appl. No.: 09/261,909

(22) Filed: Mar. 3, 1999

Related U.S. Application Data

(60) Provisional application No. 60/077,003, filed on Mar. 6, 1998.

(51) Int. Cl.[7] ..... E04D 1/16

(52) U.S. Cl. ..... 52/518; 52/314; 52/535; 52/539; 52/519; 52/521; 52/536; 52/553; 52/550; 52/302.4

(58) Field of Search ..... 52/521, 536, 553, 52/550, 541, 542, 314, 535, 539, 519, 302.4

(56) References Cited

U.S. PATENT DOCUMENTS

| | | | |
|---|---|---|---|
| 3,862,532 | 1/1975 | Markos . | |
| 4,262,466 | 4/1981 | Roe . | |
| 4,372,090 | 2/1983 | Shichijo . | |
| 4,574,536 | 3/1986 | Bamber et al. . | |
| 4,606,164 | 8/1986 | Mendez . | |
| 4,731,969 | 3/1988 | Baker et al. . | |
| 4,783,944 | 11/1988 | Mendez . | |
| 4,890,432 | 1/1990 | Shepherd . | |
| 4,914,885 | 4/1990 | Baker et al. . | |
| 5,214,895 | 6/1993 | Fifield . | |
| 5,268,028 | 12/1993 | Fifield . | |
| 5,305,570 | 4/1994 | Rodriguez et al. . | |
| 5,323,581 | 6/1994 | Jakel . | |
| 5,406,766 * | 4/1995 | Nicholas et al. | 52/555 |
| 5,502,940 | 4/1996 | Fifield . | |
| 5,540,029 | 7/1996 | Elias . | |

* cited by examiner

*Primary Examiner*—Christopher T. Kent
*Assistant Examiner*—Jennifer I. Thissell
(74) *Attorney, Agent, or Firm*—Madson & Metcalf

(57) ABSTRACT

Roofing tiles have dimensions differing from conventional tiles to allow manufacture of the tiles in a substantially greater size than conventional tile sizes. The tiles may be installed more rapidly, since each piece of material must be separately installed and a single tile may cover a greater area. Additional ribs are added underneath the interior portion of each tile than with conventional tiles. The ribs are spaced appropriately such that a person walking over each tile would have the weight of a single foot distributed over one or more ribs at all times. Moreover, the rims of each tile extend substantially deeper, through the thickness, of the tile. Each tile has material removed from the main surface portion, or the actual surface opposite the weather-exposed surface, to reduce the weight therefrom. Each tile may be configured with open air channels underneath each tile up and down the entire roof. Tiles may further be installed with no batten boards or furring strips, thus providing a complete availability of drainage and ventilation underneath the tiling system.

22 Claims, 15 Drawing Sheets

LIGHT-WEIGHT, REINFORCED, EXTRUDED ROOFING TILE

RELATED APPLICATIONS

This application claims priority to U.S. provisional patent application Ser. No. 60/077,003 filed Mar. 6, 1998.

BACKGROUND

1. The Field of the Invention

This invention relates to building products and, more particularly, to cast and extruded, cementitious tiles covering structures such as roofs.

2. The Background Art

Tiles have been used since ancient times. Clay tile is ubiquitous throughout Europe, the Americas, and other continents. Tiles produce many benefits. One of the benefits is longevity. Tiles, being manufactured predominantly of earthen materials, can survive the ravages of the elements. Nevertheless, tiles are heavy. Moreover, tiles can be rather fragile. High tensile strength is not normally available in tile materials. Moreover, adding the thickness of particular sections in order to improve strength properties becomes a very weighty proposition.

In modern construction, manufacturing processes, shipping, handling, breakage, installation, and so forth affect the utility of the materials. Lightweight is desirable, but unavailable in certain materials. Strength is a benefit, and is often relied on in materials, such as steel in place of wood, and so forth, in order to reduce weight while improving strength therein.

In roofing systems, asphalt shingles have been used for many years. In addition, other types of roofing based on manufacturing materials have been used. In addition, cedar shakes have been a preferred roofing material in certain environments. Nevertheless, wood being a plant material, inherently rots over time and decays, unlike earthen materials such as tiles.

Sealing a roof is a fundamental purpose of roof-covering materials. As a practical matter, a roof must have sufficient slope to shed rain, snow, and heat, effectively. A steeper pitch on a roof becomes problematic. Installation, maintenance, support, and the like for tiles may become a major issue. Thus, tiling systems are needed, which can provide sufficient structural integrity of tiles and which can be installed by methods that are sufficiently durable and economical.

Tiles may be walked upon by workmen during or after installation. Accordingly, breakage of tiles, especially near the overlap regions or in the center or unsupported region, is a common problem.

Breakage may expose, eventually, the interior of a building to water. Roofing systems must shed water and resist leaks. Roofing systems will typically support snow as it freezes, thaws, cycles through freezing and thawing, and eventually is melted or otherwise eliminated from a rooftop.

However, ventilation is not typically provided underneath a tile. Tiles typically close off the spaces underneath so that air is not able to flow upwardly or downwardly along the surface of a roof or otherwise underneath a tile. Moreover, condensation of humidity creates moisture underneath a tile. Wood strips, battens, cleats along the top edge of the tile, and other obstructions used in typical tiling systems may obstruct the flow of water resulting from the condensation. Accordingly, water cannot drain from underneath the tiling system. Also, a tile may break and produce a leakage path of moisture underneath the tile. Conventional tiling systems do not provide for ready runoff of such water. Thus, condensation, leakage, and ventilating air, are obstructed in conventional tiling systems.

What is needed is a tiling system for roofing that provides several advantages. A required advantage is lighter net weight of the roofing load. An additional advantage is greater strength for tiles in order to support against breakage by poor handling and walking on the roof by workmen. Also needed is a ventilation system for providing evaporation of any moisture that may accumulate beneath tiles in a roofing system, as well as providing drainage along the roof surface underneath the tiles.

Another need is a reduction of the damage produced by a tile system on the sealing material that may be placed over the fundamental structure of a roof. For example, rafters may support some kind of decking material, such as plywood or other sheathing. Over the sheathing may be placed a barrier, such as a vapor barrier, moisture barrier, or the like. For example, elastomeric polymer sheets may be used. Likewise, tar paper or asphalt roll paper, or felt, may be used.

Many sealing materials are available, but these materials are no match for the hardness, and abrasiveness of materials typically used in tiles. Accordingly, any tile resting on a surface covering may be cut through by tile edges with time, motion, and the presence of people walking thereon.

Thus, a tiling system is provided in accordance with the invention that obtains several structural advantages and advantages in installation.

BRIEF SUMMARY AND OBJECTS OF THE INVENTION

Roofing tiles made in accordance with the invention may be made by extrusion, casting, or other processes known in the art. The dimensions of the tiles are changed dramatically from those of conventional tiles. The tiles may be manufactured in a size that is substantially greater than conventional tile sizes. Accordingly, the tiles may be installed more rapidly, since each piece of material must be separately installed and a single tile may cover a greater area. Additional ribs are added underneath the interior portion, rather than around the border or edge of each tile. Moreover, the rims extend substantially deeper, through the thickness, of the tile. Material has been removed from the main surface portion, or the actual surface opposite the weather-exposed surface, to reduce the weight therefrom. However, the ribs are spaced appropriately such that a person walking over the tile would have the weight of a single foot distributed over one or more ribs at all times.

In the tiles made in one embodiment in accordance with the invention, longitudinal ribs and lateral ribs may both be provided. In addition, multiple longitudinal ribs and multiple lateral ribs may be provided. A lug or cleat may be provided for engaging a furring strip or batten. Nevertheless, the lugs may support the tile without resort to a batten or furring strip. Moreover, open air channels are maintained underneath each tile up and down the entire roof. Accordingly, in one presently preferred embodiment, tiles may be and should be installed with no batten boards or furring strips, thus providing a complete availability of drainage and ventilation underneath the tiling system.

The net thickness of the gutter section of each tile, engaging the next adjacent tile, is substantially thicker to greatly increase strength. For example, in most designs known in the art, engagement sections, keyed sections, overlaps and the like maintain less than half the net material dimension (transversely normal to the roof surface of the tile). These present less than an eighth of the nominal tile strength in the gutter area of the tile as opposed to the strength over the main area, for the engagement or overlap sections. In a design in accordance with the invention, the gutter thickness is substantially greater. Moreover, net width laterally is comparatively less. Since the strength is related to the third power of thickness, increasing the transverse dimension of any portion of the tile is substantially more effective than increasing the width in a longitudinal or lateral direction.

Thus, overlaps and ribs greatly increase strength, borrowing material from the thickness of clear spans therebetween. In one embodiment, a slanted edge or bottom surface of the ribs may be provided for fitting flat on a roof. This avoids any corners touching sealing materials or surfacing materials that may be placed underneath the tiles. Thus, the lower edge of a tile is ribbed, but each rib is angled to fit flat on the roof, while leaving a reinforced clear channel (for ventilation and drainage). Meanwhile, the top cleat at the top edge sits on the next tile up.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the FIGS. 1 through 15 herein, could be arranged and designed in a wide variety of different configurations. Thus, the following more detailed description of the embodiments of the system and method of the present invention, as represented in the Figures, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings wherein like parts are designated by like numerals throughout.

Figure 1:
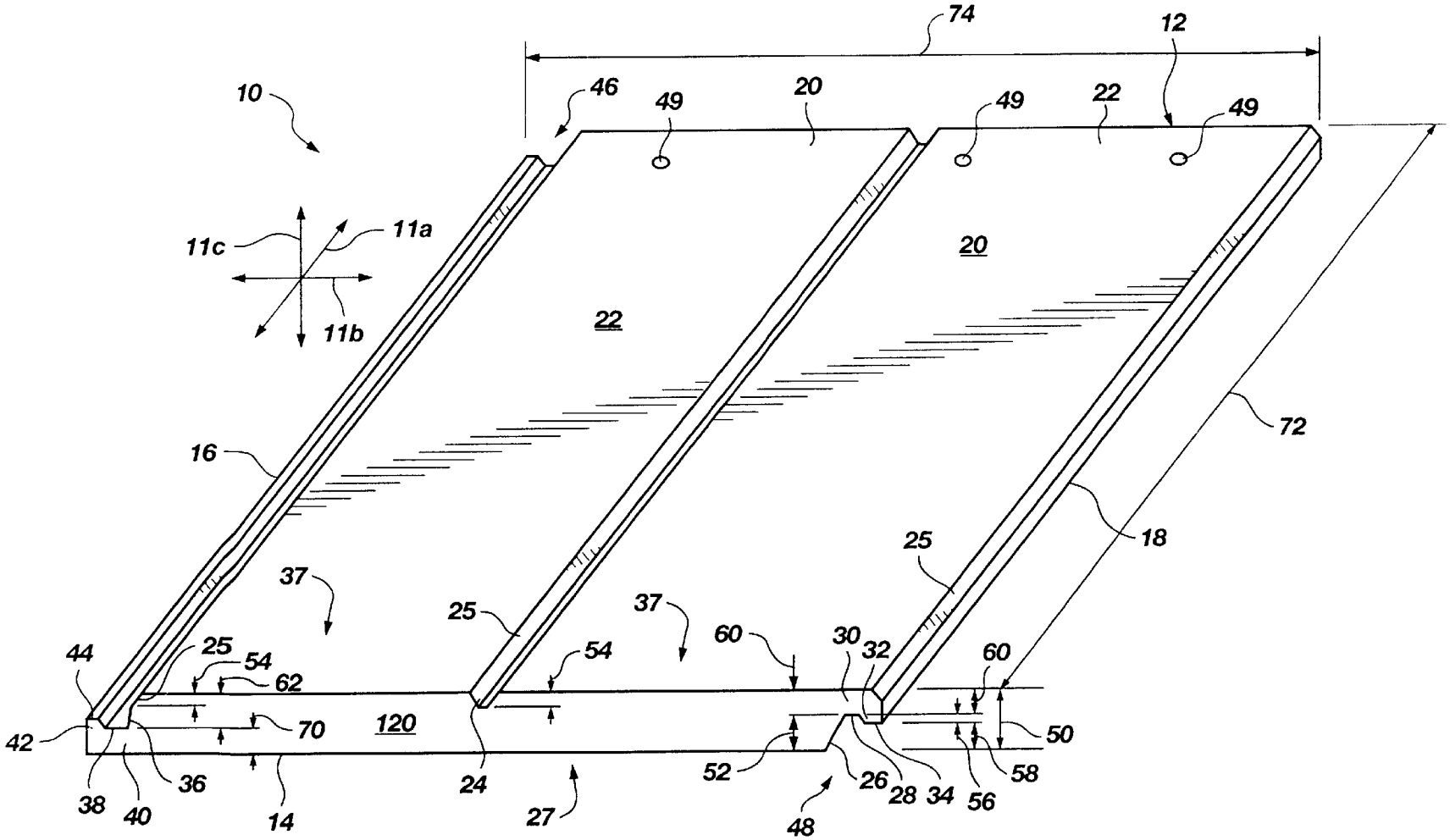
FIG. 1 is top view of a tile in accordance with the invention.

Referring to FIG. 1, a tile 10 may be constructed by one of a variety of processes, from a moldable material. In one presently preferred embodiment, a cementitious material, having a concrete-like appearance may be used. Suitable pigments, texturizers, strengtheners, and other materials may be formulated into a suitable composition. The material will preferably withstand the effects of weather by maintaining a comparatively impervious structure not susceptible to freezing, thawing, absorption of moisture, and the like.

In one embodiment, a tile 10 may be fabricated to extend in a longitudinal direction 11*a,* a lateral direction 11*b* and a transverse direction 11*c*. A tile 10 may be described in terms of a head 12 or head end 12 opposite a foot 14 or foot end 14. A tile 10 may be installed to form a protective layer over a roof structure. The head end 12 is positioned vertically higher than the foot end along the slope of a roof.

In order to consistently shed moisture from rain, snow, and the like, a tile 10 may be formed to have laps 16, 18. The sidelaps 16, 18 may be formed to lap or overlap one another on laterally adjacently positioned tiles. Also, tiles are installed in an overlapping arrangement of foot ends 14 resting upon head ends 12 of tiles 10 positioned adjacent one another in a longitudinal direction 11*a*. Thus, each foot 14 sits above and in contact with a head 12, with respect to a transverse direction 11*c*. Similarly, tiles 10 installed adjacent one another in a lateral direction 11*b* overlap one another at respective sidelap portions 16, 18.

Accordingly, a sidelap 18 or side overlap 18 will rest above (with respect to transverse direction 11*c*) a sidelap 16 of a laterally 11*b* adjacent tile 10. Inasmuch as tiles 10 are installed on a sloped roof having a declining slope extending in a longitudinal direction 11*a,* a foot 14 may rest on a head 12. However, since tiles 10 that are laterally 11*b* adjacent one another will have the same elevation at any particular point along a roof structure (underlying supporting structures such as battens, decking, etc.) the overlap 18 must fit over and within the underlap 16. Thus, the underlap 16 may be thought of as a gutter portion 16, while the overlap 18 may be thought of as a cover portion 18.

In one presently preferred embodiment, a tile 10 may be designed to have a plurality of panels 20, 22, rather than a single panel 20. In conventional tiling an individual tile 10 has a single panel 20, from which extend some form of underlap 16 and overlap 18 in a lateral direction. With a design made in accordance with the invention, two panels 20, 22 may be included in a single tile 10, while having the appearance of comparatively large, conventional, individual, clay tiles 10.

The panels 20, 22 may be delineated or bounded by a divider 24 or gutter 24 therebetween. The divider portion 24 may have a chamfer 25 similar, or identical, in appearance to the chamfer 25 provided on the underlap 16 and overlap 18. The overlap section 18 may be provided with a matching bevel 26. The bevel 26 also serves as a draft 26 for improving ease of release from a molding operation or molding machine.

For example, the tiles 10 may be made by extrusion, molding, and similar processes. A die may be used to shape the tile 10, and particularly the Geometries of the panels 20, 22 and the laps 16, 18. Accordingly, some amount of draft 26 may be appropriate. Moreover, structurally, a bevel 26 may provide additional structural integrity according to St. Venant's principal. That is, principal stress in isotropic materials typically acts at a forty five degree angle with respect to principal stresses (compression and tension). Accordingly, free rectangular corners are not helpful. Thus, a bevel 26 may be adapted to optimize weight, size, shape, and stresses within the tile 10.

The bevel 26 may extend from a lower surface 27 to a ceiling 28 or finger span 28 cantilevered near the edge of the panel 20 forming a finger 30. The finger 30 may angle downward to form a tip 32, likewise angled or beveled somewhat like a mirror image of the bevel 26, so far as the tip 32 extends.

The tip 32 terminates at a surface 34 or face 34 designed to interlock with the sidelap 16. Thus, the tip 32 adjusts the position of the tile 10 with respect with to a sidelap 16 of an adjacent tile 10 laterally positioned next to an original tile 10.

The finger 30 is adapted for strength and support superior to those produced by other methods in other apparatus. The strength of the finger 30 is increased substantially by redistributing the material in the tile 10 as described herein. Accordingly, the section modulus of the finger 30 is considerably greater than any corresponding appendage of a conventional tile, and yet is thinner than traditional clay, semi-circular tiles, traditionally seen for hundreds and thousands of years in Europe and the Mediterranean area. Moreover, the sidelap 16 may be designed in certain, presently preferred embodiments in order to completely underlie and support the entire sidelap 18, even when staggering is used in installation processes or a staggered configuration is designed for offsetting the panels 20, 22 with respect to one another.

Referring to the sidelap 16, also referred to as the gutter portion 16 of the tile 10, a bevel 36 or draft 36 may extend from a chamfer 25 off the top surface 37, downwardly to a gutter surface 38 or face 38 for transporting moisture longitudinally 11*a* along the tile 10. The gutter surface 38 or surface 38 may be thought of as forming a channel 46 interweaved with a channel 48 of the sidelap 18. One may note that each of the channels 46, 48 need only conduct moisture away from the individual tile 10 to which they pertain, since moisture is discharged onto a longitudinally 11*a* adjacent tile 10 therebelow. Likewise, a comparatively close fit between the face 34 and the face 38 need present no difficulty to the transport of moisture. Capillary action is operational and of substantial effect in gaps less than approximately one quarter inch. Accordingly, surface tension forces can maintain moisture against overflowing the gutter 46.

The sidelap 16 underlying the sidelap 18 may have a toe 40 for extending under the sidelap 18 across the surface 34. The toe 40 may terminate with a tip 42 provided with a face 44 or surface 44 adapt to fit within the channel 48 against the surface 28 of the sidelap 18.

In one embodiment, the channels 46, 48 may be very nearly mirror images of one another, particularly insofar as the finger 30 and toe 40 are concerned and with respect to the tip 32 and tip 42. Nevertheless, the bevel 25 may provide a practical benefit in relieving mold surfaces for providing easy removal of a tile 10 during molding or extrusion processes. Since no particular benefit would be gained by placing a bevel 25 on the tip 42 near the bottom surface 27, exact, mirror identity is not necessarily required or useful between the sidelap 16 and the sidelap 18. Thus, a gutter channel 46 is adapted for underlying a cover channel 48. The finger 30 and tip 32 may thus engage the toe 40 and tip 42 in an alignment function, as well as a sealing function.

Tiles 10 may be attached to a roof structure in one of a variety of ways. Typically, tiles may be formed with a cleat near an upper end 12 or head 12 for engaging a purlin or a batten extending between rafters of a roof truss or attached to decking over rafters of a roof structure. In accordance with modern earthquake and storm provisions of building codes, a tile 10 may be adapt to be secured to a roof structure. Accordingly, apertures 49 may be disposed, periodically or otherwise, near the head 12 of a tile 10. Each aperture 49 may be sized to receive a nail or fastener of suitable dimension to secure the tile 10 against a roof structure.

Because the tiles 10 do not require battens, furring strips, or purlins in order to engage a roof structure, the apertures 49 may be provided differently from conventional tile systems. For example, more apertures 49 may be provided. Traditionally, not every traditional tile is securely fastened to a roof structure in a transverse direction 11*c*. However, having several apertures 49 in each tile 10 in accordance with the invention may provide for fastening all tiles 10 exclusively by fasteners throughout the apertures 49. Accordingly, screws, available in automated equipment, nails, staples, studs, pegs, brackets, and the like may extend throughout the apertures 49.

In one embodiment, a tile 10 may be lifted at the foot 14 to expose a longitudinally 11*a* adjacent tile 10 for replacement. In such a case, a short cleat or batten strip may be placed under the tile 10, obviating, for a single, new, replacement tile 10 a need to reuse nails and apertures 49 in an inaccessible location. Nevertheless, tiles 10 may be installed exclusively with fasteners throughout the apertures 49, without the need for battens extending laterally 11*b* across the entire roof structure.

A tile 10 may have a maximum thickness 50 extending between a bottom surface 27 and a top surface 37. Nevertheless, the thickness 50 in a tile 10 in accordance with the invention is designed to provides substantial improvements over conventional tiling systems. For example, the thickness 50 may be substantially greater than that of conventional tiles, while not being uniform over the entire tile 10 in any dimension 11*a*, 11*b*. Notwithstanding the sidelaps 16, 18, the thickness 50 may be substantially greater than a corresponding thickness of a conventional tile while redistributing material in a tile between the head 12 and foot 14 and between the sidelaps 16, 18, as will be discussed hereinafter.

A depth 52 of a channel 48 may be provided to clear the surface 44 and tip 42 of the toe 40. Meanwhile, the depth 54 of a chamfer 25 may be selected for aesthetic reasons, as well as to provide a substantially clear and guiding conduit for moisture running off a tile 10.

The chamfer 25 is not required. Nevertheless, the chamfer 25 also provides a certain amount of relief in placing tiles, while relaxing tolerance requirements and providing for an easier fit and less breakage in fitting tiles 10 together.

A depth 56 of the tip 32 of the finger 30 may be designed to match the tip 42 of the toe 40. Accordingly, a clearance 58 is provided for accommodating the toe 40 and surface 38. In one embodiment of an apparatus 10 in accordance with the invention, the clearance 58 may be substantially greater, due to the additional material and size provided for the toe 40 as well as the finger 30.

For example, the thickness 60 of the finger 30 may be substantially greater than would be a corresponding thickness in a conventional tile. A section modulus relates directly to maximum stress at an outermost fiber in a flexurally loaded (bending) beam. Moreover, a section modulus is proportional to a base or width to a first power, and a depth 60 to a third power. Accordingly, any improvement in a depth 60 of a finger 30 is compounded by a third power. For example, doubling the thickness 60 will multiply a section modulus by a factor of 8. Thus, the depth 56 of the tip 32 may be comparatively shorter, in order to accommodate a greater thickness 60 in the finger 30, as well as increasing the dimension of the toe 40.

Figure 2:
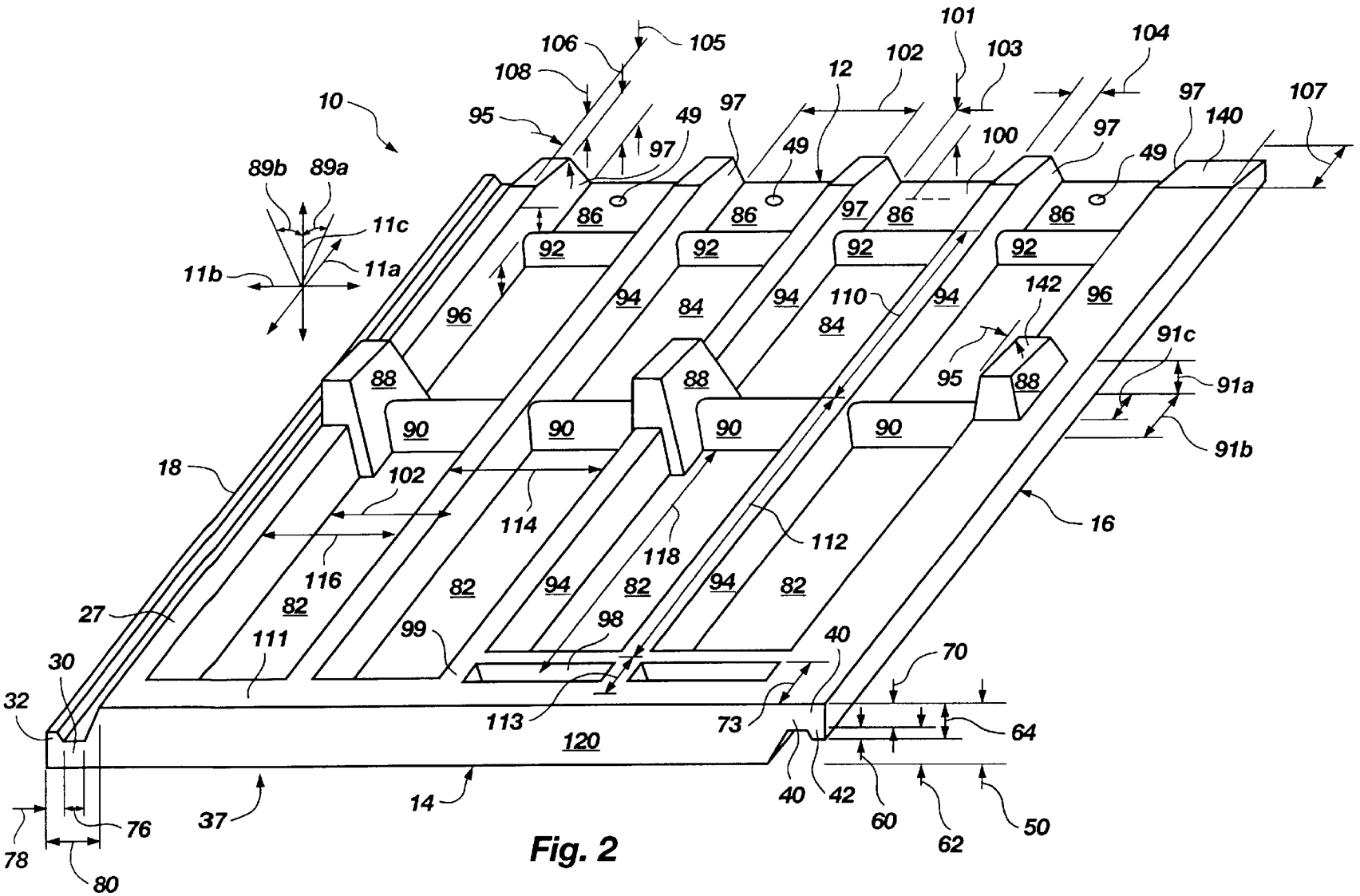
FIG. 2 is a bottom view of the tile of FIG. 1.

Referring to FIG. 2, and generally to FIGS. 1–4, a depth 62 of a gutter channel 46, may be sized to accommodate the finger 30 and finger tip 32 of the sidelap 18. Accordingly, a toe height 64 may selected for fitting within the cover channel 48. A tip height 66 may be adapted to matingly engage the tip 32 of the channel 48, interlocking the sidelaps 16, 18 of adjacent tiles 10. In one embodiment, the thickness 70 of the toe 40 may be exactly the same as the thickness 60 of the finger 30.

Nevertheless, the exact dimensionalities need not be equal. Rather, corresponding and mating dimensions of the finger 30 and toe 40 need to be consistent with one another. Also, to provide adequate strength for supporting service, walking over by persons, installation, and handling abuses, maximum thicknesses 50, 60, 70 are desirable. Nevertheless, the channel 46 must carry runoff moisture. Therefore, the height 66 of the tip 42 should be sufficient that any head height of moisture in the channel 46 may be overcome by the height 66 and the surface tension of the moisture combined.

Referring to FIG. 1 again, a tile 10 may have a length 72 selected to meet several criteria. Similarly, a width 74 may be selected in a lateral direction 11*b* in accordance with various, applicable, appropriate criteria. For example, building codes require tiles 10 to maintain sufficient strength to support a person walking thereon. Thus, a tile 10 made in accordance with the invention needs to have sufficient strength, alone, to survive testing adapted to determine the ability of a tile 10 to support a person walking thereon. Also, a length 72 may be adapted to provide an aesthetic appeal of the amount of each panel 20, 22 exposed when longitudinally 11*a* adjacent tiles 10 are overlapped.

Also, a length 72 may be sufficiently long to minimize labor involved during installation. For example, a longer length 72 implies that fewer tiles 10 may be required to cover a particular expanse in a longitudinal direction 11*a*. Also, the length 72 may contribute to an increased moment due to loading near the center of a tile 10. Accordingly, an excessive length 72 begins to increase the maximum load in the outermost fiber (maximum dimension from a neutral axis, from an engineering perspective) of the tile 10.

In one embodiment, a suitable length 72 may also be selected to optimize the total weight of a tile 10. For example, an installer must lift each tile 10 from a stack and position the tile 10 on a roof structure for installation. Excessively large dimensions 72, 74 may result in too much weight in each individual tile 10, or merely a very unwieldy size, inconvenient and tending to increase breakage from dropping of striking other objects.

In one embodiment, a length 72 may be approximately 16 inches. In an apparatus 10 in accordance with the invention, a length 72 of 16 inches provides superior strength over conventional tiling systems. Similarly, the width 74 may be selected according to similar criteria, including, support, handling, and the like. However, conventional tiles do not provide a width 74 corresponding to the width 74 of the tile 10. The width 74 may be approximately 16 inches also.

Increased width 74 has an advantage in that the loss of coverage due to overlapping of the sidelaps 16, 18 in adjacent tiles 10 becomes a lower fraction of the overall dimension 74. Accordingly, more coverage may be obtained from fewer tiles 10. Moreover, a tile 10 in accordance with the invention relies on a substantial redistribution of material throughout the tile 10, in order to optimize strength and weight. Because the material has been redistributed, as compared with conventional tiles, a tile 10 may have increased strength, and reduced weight over tiles made by conventional methods and having lesser dimensions 72, 74. Thus, the net effect of a tile 10 in accordance with the invention is a lighter tile 10, covering more roof area with a fewer number of tiles, with superior strength and resistance to breakage due to mishandling and walking thereon by people.

Referring to FIG. 2 and continuing to refer generally to FIGS. 1–4, a width 76 of a finger span 28 affects strength of the finger 30 directly, to a first power. By contrast, the thickness 60 of the finger 30 affects strength to a third power. The same principals apply to the comparative widths 78, 80 of the tip 32 and lap 18, respectively, with respect to the depths 60, 56. Thus, a tile 10 in accordance with the invention may rely on a net width 80 of a lap 18 substantially less than a corresponding overlap of a conventional tile. The width 80, due to the mating nature of the sidelaps 16, 18, corresponds to the same width of the sidelap 16 forming the gutter channel 46.

A panel 82, of which the panels 84, 86 may be considered instances, may extend across portions of the tile 10. Material is exchanged from the region of the panels 82 in order to provide reinforcement selectively about the tile 10. Such redistribution provides additional strength as needed in the tile 10.

However, lugs 88 or cleats 88 may be provided, extending from the under surface 27 of a tile 10. The lugs 88 may be positioned to support the tile 10 between the head 12 resting on a roof structure, and the foot 14 resting on a longitudinally 11*a* adjacent tile 10.

The cleats 88 or lugs 88 may be tapered along a longitudinal angle 89*a* and a latitudinal angle 89*b*. The longitudinal angle 89*a* and the latitudinal angle 89*b* may be unique to the lugs 88, but may also be the same for ribs 90, 92, 94. The ribs 90, 92, 94 extend across the bottom surface and may be disposed longitudinally, laterally, as well as diagonally. The ribs 90, 92, 94 may be disposed in various angles with respect to the head end 12 and the sidelap 16 to thereby increase a strength to weight ratio of the panel.

In one presently preferred embodiment, the ribs 90 extend laterally 11*b* across the tile 10. Each has a corresponding height 91*a* extending away from the panels 82, a base width 91*b* extending longitudinally 11*a* along the tile 10 at a panel 82, and may have a top width 91*c* extending longitudinally 11*a*. Nevertheless, in one presently preferred embodiment, each of the lateral ribs 90, of which the ribs 92 are a particular instance, may be rounded for structural, aesthetic, material, and airflow reasons.

The ribs 94 extend in a longitudinal direction 11*a*. The ribs 94 may be tapered at an appropriate lateral angle 89*b*. Similarly, the lateral ribs 90 may be tapered at a longitudinal angle 89*a*. The angles 89*a*, 89*b* need not be identical for the lugs 88 and ribs 90 or ribs 94.

The panels 82, of which the panels 84, 86 are specific instances positioned longitudinally 11*a* toward the head 12, may contain less material than would a corresponding region in a conventional tile. The material that could have been applied to the panels 82 between the top surface 37 and bottom surface 27 of the tile 10 is instead distributed through the ribs 90, 96. Material removed from the panels 82 or redistributed from the panels 82, reduces the flexural modulus or section modulus of each panel 82 over a comparatively large area. Redistributed to the ribs 90, 96, the material increases substantially the section modulus of the ribs 90, 96.

Each of the panels 82 can well afford decreased strength when supported by underlying ribs 90, 96. Again, since section modulus is proportional to a third power of a depth dimension, ribs 90, 96 substantially increase the section modulus of the tile 10, while the comparatively small reduction in the section modulus of the panels 82 provides an inordinately greater modulus in the ribs 90, 96. Moreover, the panels 82 do not have extensive clear spans. For example, no panel 82 is left unsupported in a lateral direction 11*b* across the entire width 74 of the tile 10, as would be the case in conventional tiles. Thus, the redistribution provides a minimal reduction in section modulus for the panels 82, which do not need strength, being reinforced by ribs 90, 96, and provides great increases in the section modulus of the tile 10 overall by way of the ribs 90,96.

In one embodiment, each of the ribs 94, may be tapered through an angle 95 near the head 12 thereof The angle 95 may be selected to correspond to the angle at which each tile 10 is disposed when resting at the head 12 on a roof structure, and at the foot 14 on a longitudinally 11*a* adjacent tile 10.

The angle 95 may also be provided as a modification of each of the cleats 88 or lugs 88. Thus, greater surface contact area on a supporting roof structure is available to the lugs 88 and ribs 94. Meanwhile, since each tile 10 will be disposed at this same angle 95, along a top surface 37, parallel to all other tiles 10 in the roof system, the foot 14 may be supported substantially along the entire width 74 thereof by a flat upper surface 37 of a longitudinally 11*a* adjacent tile 10 therebelow.

Eliminating corners from the ribs 94 during contact with an underlying roofing structure distributes the weight of tiles 10 over a substantially larger area than would conventional tiles. Moreover, since the lugs 88 also provide substantial surface area in flat contact with the underlying roofing structure, any sealing materials placed over a roof structure and beneath a tile 10, will receive substantially lower stresses, reducing leakage, and the possibility of tearing through.

The ribs 96 are instances of ribs 94, disposed near the sidelaps 16,18. As with all the longitudinal ribs 94, the tapered portions 97 are adapted to accommodate the installation angle 95 of tiles 10. Since the depth 70 or thickness 70 of the toe 40 is increased over that of conventional tiles, the outer ribs 96 have sufficient dimensions 70 to accommodate the tapered sections 97.

In one embodiment, a tile 10 may be provided with an additional bulkhead 98. The bulkhead 98 may serve as a lateral rib 90. Nevertheless, the bulkhead 98 may also serve as a foot 14 of one panel 22 of a tile 10. For example, a die may be manufactured to provide the shape of the panels 82, lugs 88, and ribs 90, 94. An adaptation may provide a core to fill in the portion of the foot 14 beyond the bulkhead 98. Accordingly, the bulkhead 98 and extension 99 may become the outermost boundaries, in their respective regions, of the tile 10, and the panel 22, in particular. The shortened appearance of the bulkhead 98, positioned away from the foot 14, provides an additional appearance of multiple tiles of conventional dimensions laid in a staggered or offset pattern for aesthetic appeal. When a core is removed from a die, the foot 14 may extend straight across 116 the entire width 74 of the tile 10.

The panels 82 may be thought of as having a consistent and uniform dimension in a transverse direction 11*c*. Thus, each of the panels 82 may be thought of as comprising a plate 100 or as forming a portion of a plate region 100. As a practical matter, the material in the ribs 90, 94 as well as in the lugs 88, is integrally contiguous, and molded in a single cavity of a die. Nevertheless, the thickness 101 of a plate portion 100 may be considered a new nominal thickness 101 of a tile 10.

Alternatively, the thickness 50 may be considered a nominal thickness 50 of the tile 10. However, one may see that the thickness 50 becomes a thickness 50 corresponding to ribs 94, while the nominal thickness 101 is a thickness 101 of plates 100 extending over the tile 10 as panels 82. Each of the plates 100 or panels 82 has a corresponding span 102 or clear span 102 extending in a lateral direction 11*b*. The width 11*b*, unsupported between the ribs 94 is the maximum dimension that any plate 100 must support. Accordingly, the thickness 101 may reduce without risk of failure during tests or service. In one embodiment, the width 102 between ribs 94 is selected such that a shoe of a person walking on the top surface 37 of a tile 10 will always be supported by at least one rib 94.

Due to the lateral angle 89*b* of taper in each of the ribs 94, a width 103 or base width 103 of each rib 94 may be greater than the width 104 or face width 104. The angles 89*a*, 89*b* accommodate draft for molds, while optimizing structural strength at minimum weight in each of the ribs 94. Thus, at a height 105 or depth 105 of a rib 94, the width 104 need not be as great as the base width 103. As a practical matter, the lateral angle 89*b* for the draft on any rib 94 may be a 45 degree angle. However, maximum stress is allowable for compression, but this need not be a limiting factor. Therefore, in order to extend a maximum depth 105 below the plates 82, 100, the ribs 94 may have a substantially steeper angle 89*b*, closer to a right angle with respect to the lower surface 27.

The height 106 or depth 106 corresponding to the declination length 107 and declination depth 108 of the tapered section 97 of ribs 94 may be selected to maintain the integrity of each of the channels 46, 48.

The span 110 extending longitudinally between adjacent lateral ribs 90, 92 may be selected in accordance with required strength for a maximum unsupported distance in the tile 10. However, the grid work of ribs 90, 94, in conjunction with the panels 82, "box in" the undersurface 27 of the tile 10, greatly increasing the strengths thereof. The spans 110, 112 need not be equal. For example, overlapping heads 12 and feet 14 in the tiles 10 provide support. Likewise, the lugs 88 provide support. Finally, under the head 12, the tapered portions 97 of the ribs 94 provide support. Thus, the portions of the overall length 72 distributed between the ribs 90, 92 and the head 14 may be optimized for equalizing stress, and minimizing stress throughout the tile 10.

The span 113 is optional. For example, the bulkhead 98 need not be present. Nevertheless, the extension length 113 may be provided as the center-to-center distance between the ribs 90, 92, 98, just as the spans 110, 112 may.

Similarly, a span 114 represents a center-to-center distance, if the ribs 94 are uniformly spaced. Thus, a center-to-center distance 114 may be measured between any corresponding points on adjacent ribs 94. The span 116, may represent the clear span 116 between the ribs 94. Nevertheless, with tapered ribs 94, the net clear span 102 is the maximum span actually clear and unsupported in the panels 82.

Moreover, since the panels 82 are integrally formed with the ribs 90, 94, the span 102 is not simply supported. Therefore, additional strengths are available in the panel 82 above that of a simply supported plate of the same dimension. Meanwhile, the span 118 in a longitudinal direction 11*a* for each plate 82 may be designed in conjunction with the ribs 94. Accordingly, the clear span 118 and the clear span 102 may provide proper dimensions to effectively distribute weight and distribute stress more uniformly within a tile 10.

One may see that comparatively larger sizes 72, 74 of tiles 10 may be manufactured. Additional cleats 88 or lugs 88 may be added. Lugs 88 may be distributed along the longitudinal direction 11*a*. Similarly, depth 105 and widths 103, 104 of ribs 94 may be adapted for a particular configuration of clear spans 102, 118 in the panels 82.

Supplementary, lateral ribs 92 may be distributed longitudinally 11*a* to extend laterally 11*b* between the ribs 94. Thus, one may see that a tile 10, made in accordance with the invention, obtains superior strength, reduced stress, and lighter total weight than conventional tiles. Redistribution of material from the panels 82 or plates 100 into the ribs 90, 94 provides substantial flexibility of design in selecting a length 72 and width 74 of a tile 10. Moreover, provision of lugs 88 adapted to particular positions along the length 72 may decrease the net unsupported length of any rib 94. In fact, lugs 88 may be added on every rib 94. However, in certain embodiments illustrated, current building code requirements can be met, cost and weight can be reduced, while substantial labor is saved.

Figure 3:
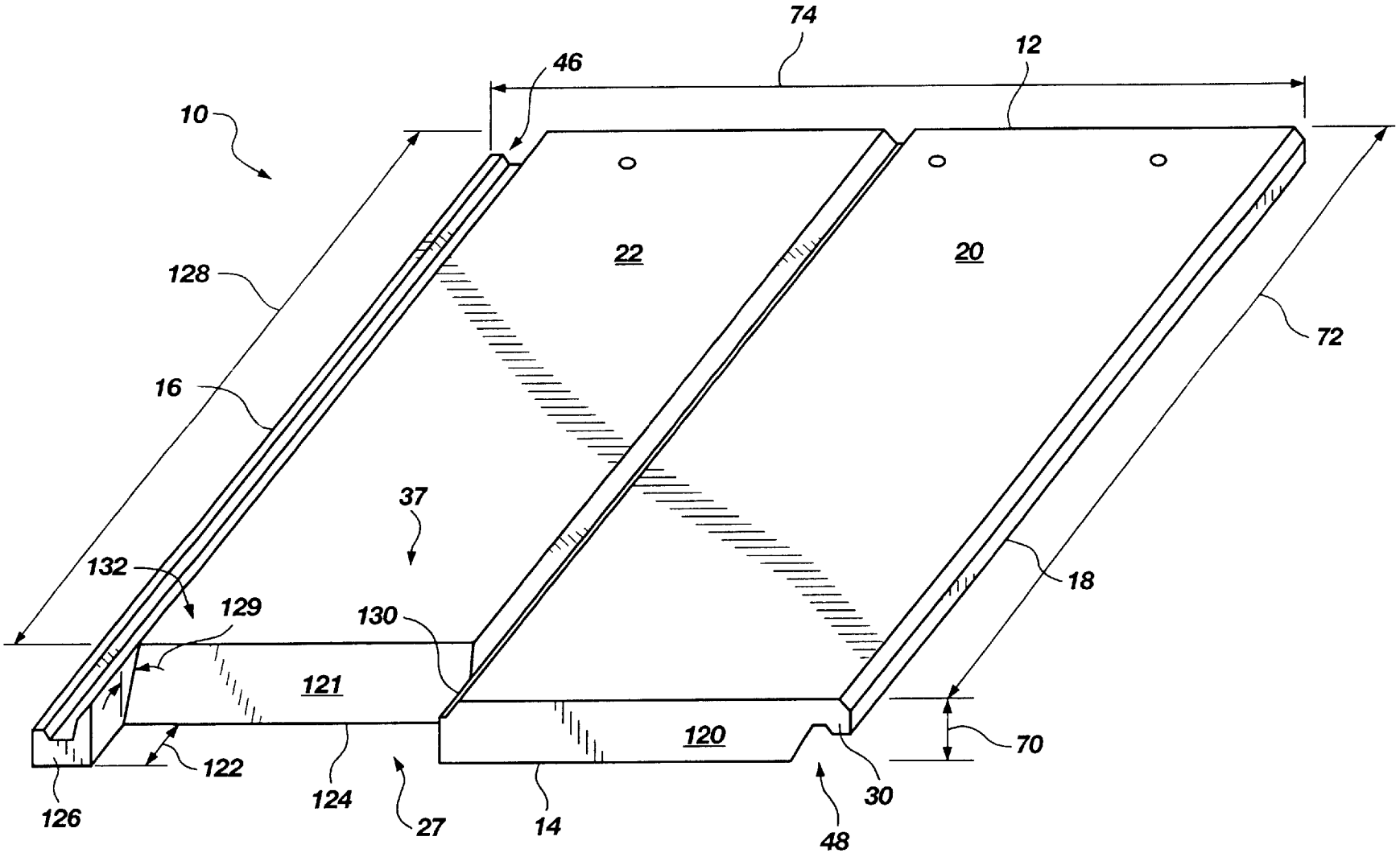
FIG. 3 is a top view of an alternative embodiment of a tile.

Referring to FIG. 3, while continuing to refer to FIGS. 1–4, a face 120 at the foot 14 of a tile 10 is typically visible to a passerby viewing a tiled roof. Accordingly, the face 120 may be fluted, scalloped, notched, beveled along a transverse direction 11*c*, and so forth. Accordingly, architectural, stylistic preferences may be accommodated by the treatment of the face 120.

Moreover, a face 121 may be offset in a longitudinal direction 11*a* away from the face 120. Thus, a setback 122 or length 122 of setback between the face 121 and the face 120 may be provided. The effect of a setback 122 is to give the appearance of multiple tiles when the panels 20, 22 are viewed for a single tile 10. Moreover, alignment by a workman of multiple tiles, or rather misalignment in order to provide the offset 122, may be unnecessary. Thus, work is sped up for installers.

The foot 14, is thus augmented by a shortened foot 124 corresponding to the face 121. However, a principal function of a tile 10 is protection of a roof against the elements. In order to operate effectively, a tile 10 must be robust for installation and service. A person walking on the foot end 14 of a sidelap 18 that is unsupported may break the cantilevered finger 30. Therefore, in one embodiment of a tile 10 in accordance with the invention, a spur 126 may be provided on the sidelap 16 forming the gutter channel 46.

The spur 126 may extend the setback distance 122 from the face 121. Accordingly, the spur 126, when installed, lies flat, parallel to a top surface 37 of a longitudinally 11*a* adjacent tile 10. Thus, the spur 126 is completely supported in compression underneath a sidelap 18 engaged therewith. Thus, a finger 30 extending over and into the spur 126 is completely supported along the entire length 72 of a panel 20. Therefore, even though a panel 22 may be shorter than a panel 20 having a length 128 shortened by the setback 122, no portion of the tile 10 is left unsupported by the roof structure.

For aesthetic reasons, the faces 120, 121 may be beveled. A bevel angle 129 or bevel 129 has several effects. First, the setback 122 need not be as extreme to achieve the same apparent offset 122 when viewed visually. Meanwhile, the underlying surface 27 under the foot 124 may be extended longitudinally 11*a* substantially closer to the foot 14, while giving a maximum appearance of offset 122. Moreover, since the angle 129 affects the appearance of light and shadow reflected from the surfaces 37 and faces 120, 121 a "difference" exists between any light reflected from the surfaces 120, 121. This difference provides an appearance of distinct surfaces 120, 121, accentuating the influence of the offset 122. Meanwhile, the underlying surfaces 27 at the foot 124 may provide more structural overlap over a head 12 of a longitudinally adjacent tile 10, improving strength while maximizing the coverage of tiles 10 with a minimum number of tiles 10.

One may think of the face 120 of the foot 14 corresponding to a long overlap section 130, with the foot 124 and surface 121 corresponding to a short overlap section 132. The bevel angle 129 maximizes the coverage by tiles 10 while maximizing the appearance of variation due to offsets 122 while providing mechanical strength according to St. Venant's principal of stress distribution along principal stress lines. Thus, the bevel angle 129 may angle back at up to forty-five degrees while maintaining substantially the same strength. Thus, the angle 129 may be limited only by aesthetic considerations, and stress limitations.

Figure 4:
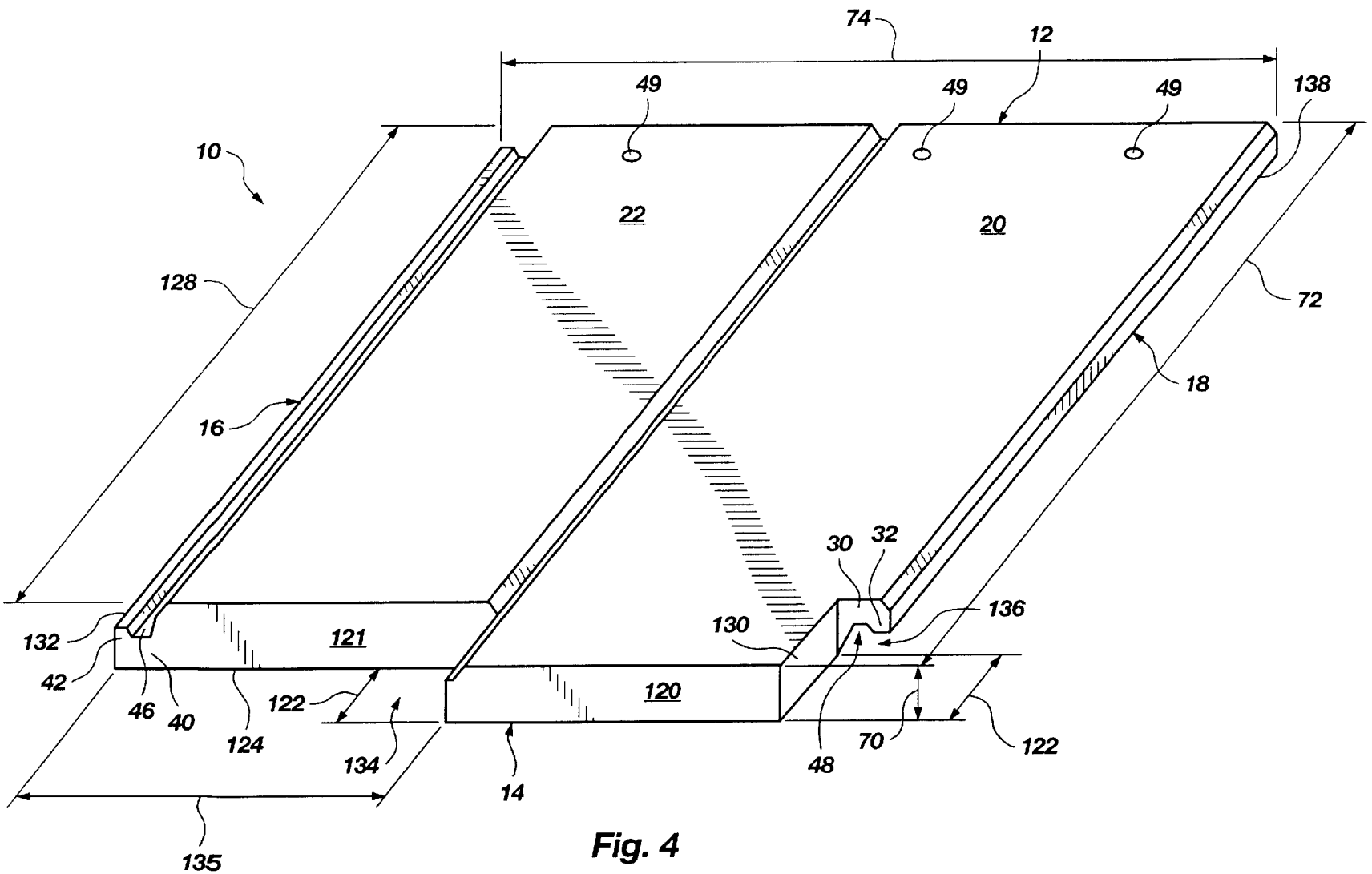
FIG. 4 is a top view of an alternative embodiment of a tile.

Referring to FIG. 4, and continuing to refer generally to FIGS. 1–4, an alternative embodiment of an offset 122 may be used. Unsupported, cantilevered sidelaps 18 may be broken more easily by the weight of a shoe of a person walking thereon. Such a problem may be exacerbated by the rise between the tip 32 and the head 12 of the next, lower, longitudinally 11*a* adjacent tile 10. Thus, a person stepping on the sidelap 18 near the foot 14 may break the finger 30. The reason that the finger 30 may be unsupported near the foot 14 is the very reason why breakage must not occur. The unsupported finger 30 is the only roof protection against moisture. Accordingly, a broken corner of a tile 10 may immediately produce a leak directly under a channel 46 of a tile 10. Thus, resistance to breakage may be a significant need.

In one embodiment, a notch 134 lacks the spur 126 of FIG. 3. Instead, the full width 135 of a panel 22 including the sidelaps 16 forming the gutter channel 46, is clear between the face 120 and the face 121. Correspondingly, a notch 136 may be formed in the panel 20. The notch 136 exposes the long overlap 130 extending to the face 120. The long overlap 130 and the short overlap 132, after installation, rest on the head 12 of a downwardly, longitudinally 11*a* adjacent tile 10. Thus, the setback 122 may be common (have a common value) for the face 121 and the notch 136.

Nevertheless, the offsets 122 at the notch 136 and the notch 134 need not be exactly equal. However, in one presently preferred embodiment, the offsets 122 may be identical for the notch 134 and the notch 136. Thus, a clean appearance is obtained in which the face 121 terminates longitudinally 11*a* with the notch 136, exposing the long overlap 130. Meanwhile, the entire sidelap 18 or finger 30 is completely supported by an underlying, fitted, toe 40. The tip 42 fits into the channel 48 completely supporting the finger 30. The tip 32 is similarly supported by the toe 40 in the gutter 46.

A tile 10 does not typically have a substantial amount of strain available. Cementitious materials tend to have greater strength in compression than in tension. Nevertheless, a tile 10 made in accordance with the invention has sufficient strength to greatly improve the durability after installation. Moreover, the tiles 10 are not rigidly connected. Rather, fasteners throughout the apertures 49 prevent sliding of tiles 10 longitudinally 11*a* down a roof structure. Meanwhile, underneath a headlap 138 or head endlap 138, the tapered portions 97 of the ribs 94 present flat surfaces 140 parallel to the underlying roof structure. Similarly, the lugs 88 present contact surfaces 142 distributing their loads flat against the underlying roof surface. Therefore, virtually every portion of the tile 10 is fully supported by direct contact of materials compressed therebelow or by the lattice work of ribs 90, 94 and supporting lugs 88 over the spans that would have otherwise been unsupported.

One advantage of the embodiment of FIG. 4 as compared with the embodiment of FIG. 3 is that the spur 126 need not be present. Although equally durable in most situations after installation, the spur 126 may present greater handling difficulties, becoming susceptible to breakage as a lone cantilevered part 126.

From the above discussion, it will be appreciated that the present invention provides several new features. Special and unique attributes of a new interlocking concrete roof tile design include tiles that are larger in size, (e.g. 16"×16") to maximize the structural flexural strength requirements of the Uniform Building Code, without exceeding the maximum standard allowable width. Midpoint support and batten engagement lugs reduce the structural span to increase dramatically the actual flexural strength performance. This also allows the roof deck load bearing to be distributed over 8 strength ribs 90, 94 and lugs 88 instead of one or two lugs 88 as with common tile. This tile 10 is designed to be installed directly to roof deck without battens, and the unique design allows moisture and air to move freely upslope under the tile 10, without the obstruction related to standard tile lug designs, producing a legitimate "cold roof" system.

High strength structural ribs may run longitudinally through the tile. Several (e.g. three) of the ribs 90, 94 are modified in one embodiment to include a midspan support and batten engagement lug 88, which bear directly on the roof deck. This maximizes and multiplies the flexural strength across the unsupported span of the tile. The horizontal strength rib at the top of the tile 10 has been designed to allow underlayment drainage in a straight, unobstructed pathway to the eave of the roof, and this also allows upslope air movement from eave to ridge (e.g. a cold roof system) that reduces ice buildup in the winter and attic temperatures in the summer.

The tile is designed to be efficient to install. It uses, in one embodiment only 71 tile per square (100 square feet). Prior art tile products use 89 to 150 pieces per square. This means fewer nails to fasten, and fewer tiles to handle. Since designed to install directly onto the deck without the use of battens on slopes below 7/12, it reduces labor and costly accessory products. The "cold roof" qualities of the invention reduce labor by 40% as compared to prior art tile "cold roof" systems, requiring vertical and horizontal strips to accomplish the same benefits.

When tested according to I.C.B.O. and U.B.C. requirements the new tile design yields a substantial improvement in strength. The unique lateral strength rib is placed where it is most able to provide strength to resist breakage from foot traffic and hail damage. The midspan support and batten engagement lugs are strategically placed for maximum strength and minimum installed weight. A "staggered" appearance with various types of "rustic" rough cut edges may be presented without actually staggering the tile installation.

The tile may incorporate a feature of marking layout to position the headlap of the tile. Marks showing the proper overlap distance may be marked directly on the tiles to aid the installer to properly position the tile with the required headlap for coursing layout from eave to ridge. A taper allows the tile to distribute its weight onto several (e.g. five) broad support areas and minimize the thickness at the upslope lap, such that the slope loss of the tile in installation, is minimized.

The tile 10 shown in the embodiments of FIGS. 1 through 4 may be embodied to have various types of top surfaces 37 and foot ends 14. In the following FIGS. 5 through 15, various possible embodiments are shown. One of skill in the art will appreciate that additional embodiments which combine various features are possible and are included within the scope of the invention.

Figure 5:
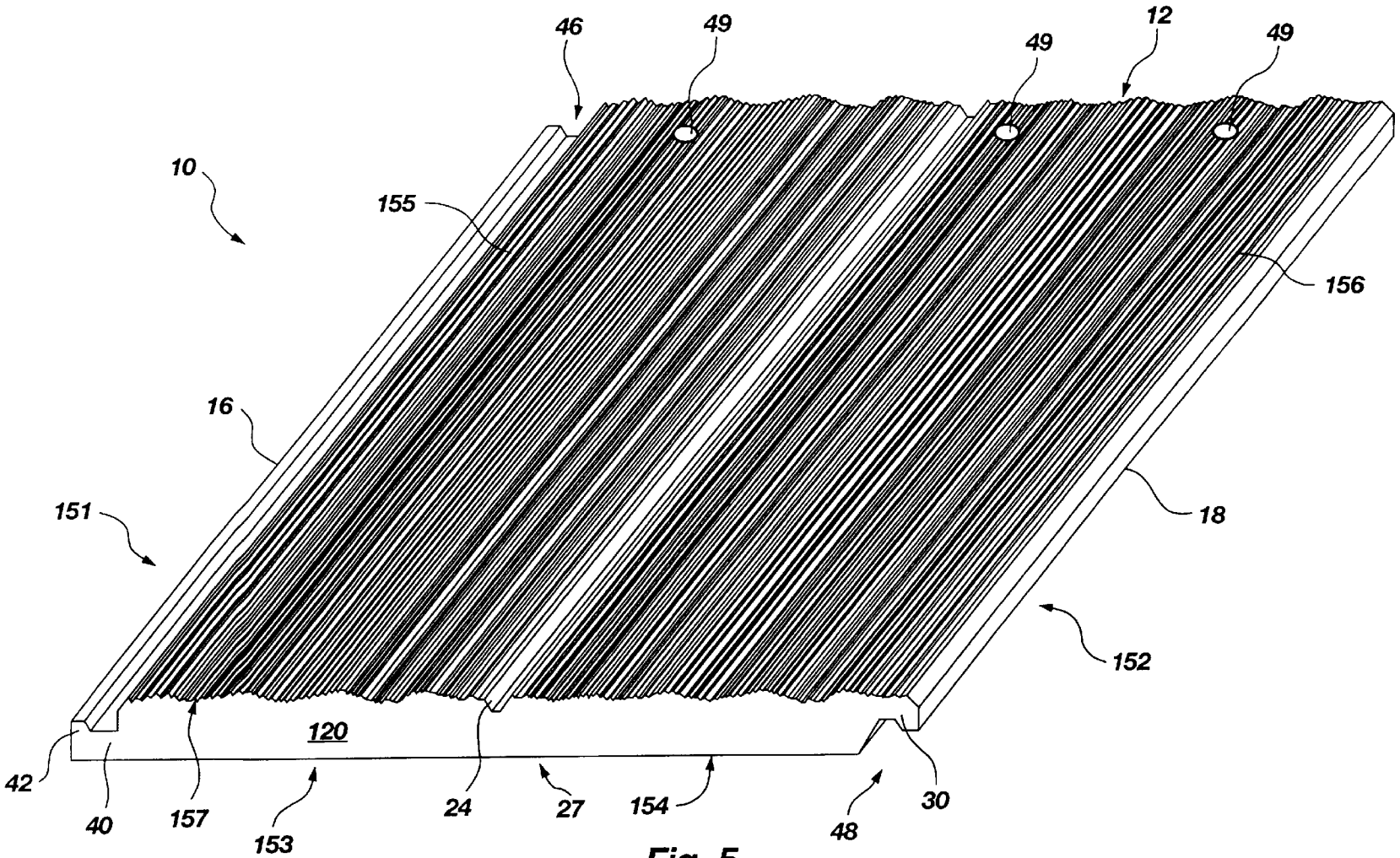
FIG. 5 is a top view of an alternative embodiment of a tile.

Referring to FIG. 5, a top view of an alternative tile 10 is shown. The tile has two panels 151, 152 which are divided by a divider 24 similar to previous embodiments. Panel 151 is referred to herein as the lapped panel due to its lower sidelap 16. Panel 152 is referred to herein as the lapping panel due to its upper sidelap 18. The face 120 illustrates the profile 153 of the lapped panel 151 and the profile 154 of the lapping panel 152. The panels 151, 152 have corresponding top surfaces 155, 156.

The embodiment of FIG. 5 is similar in most respects to that of FIG. 1. The primary difference is that the top surfaces 155, 156 comprise an undulating structure 157. The undulating structure 157 provides a rough textural appearance which serves for aesthetic purposes.

Figure 6:
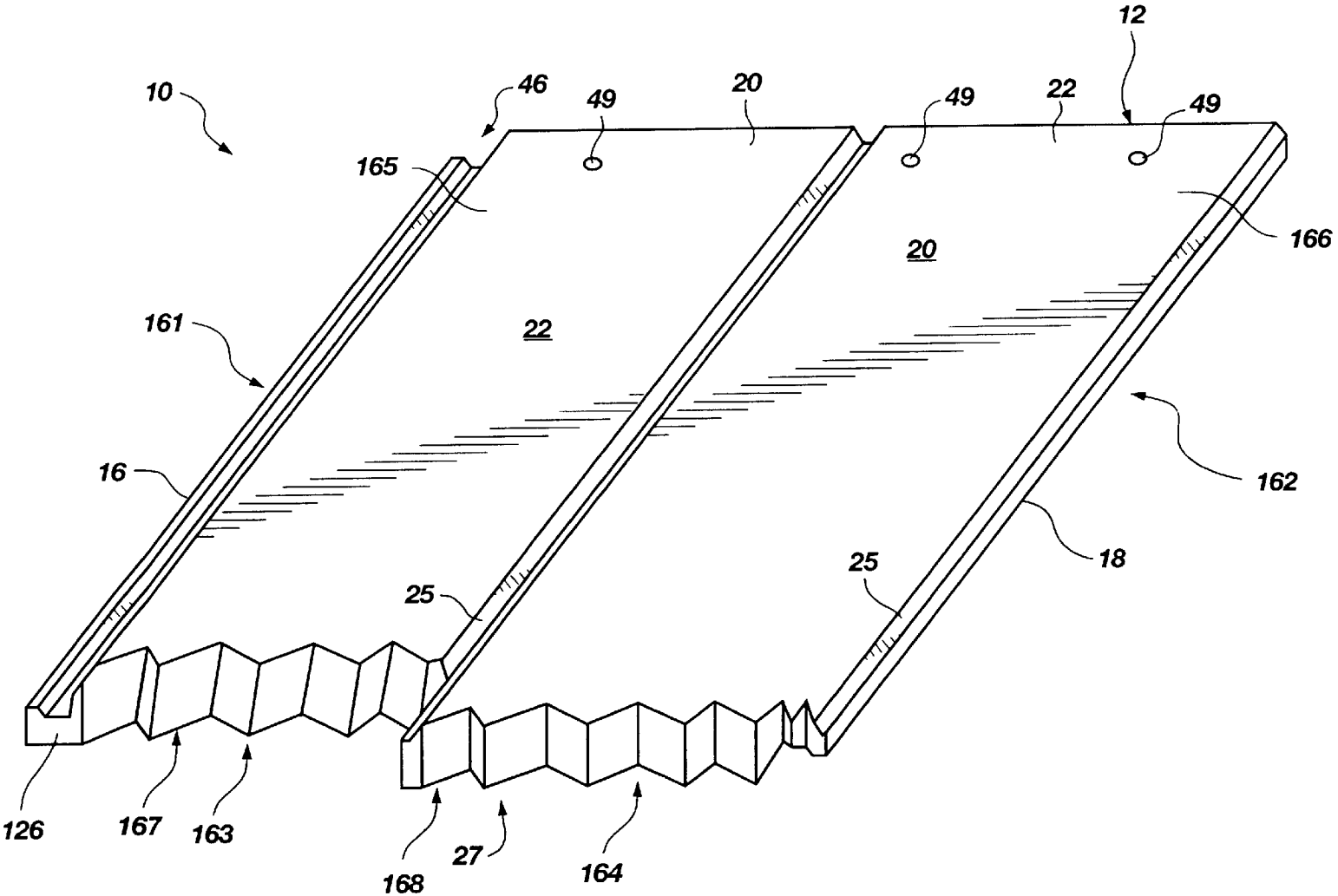
FIG. 6 is a top view of an alternative embodiment of a tile.

Referring to FIG. 6, a top view of an alternative tile 10 is shown and comprises a lapped panel 161 and a lapping panel 162. The lapped panel 161 and the lapping panel 162 have corresponding profiles 163, 164 and top surfaces 165, 166. The top surfaces 165, 166 are smooth or generally flat in this embodiment. The embodiment of FIG. 6 is primarily that of FIG. 4 except that the panels 161, 162 have jagged, oblique edges 167, 168 as indicated. The exact nature of the jagged edges may differ as desired as such edges serve an aesthetic purpose.

Figure 7:
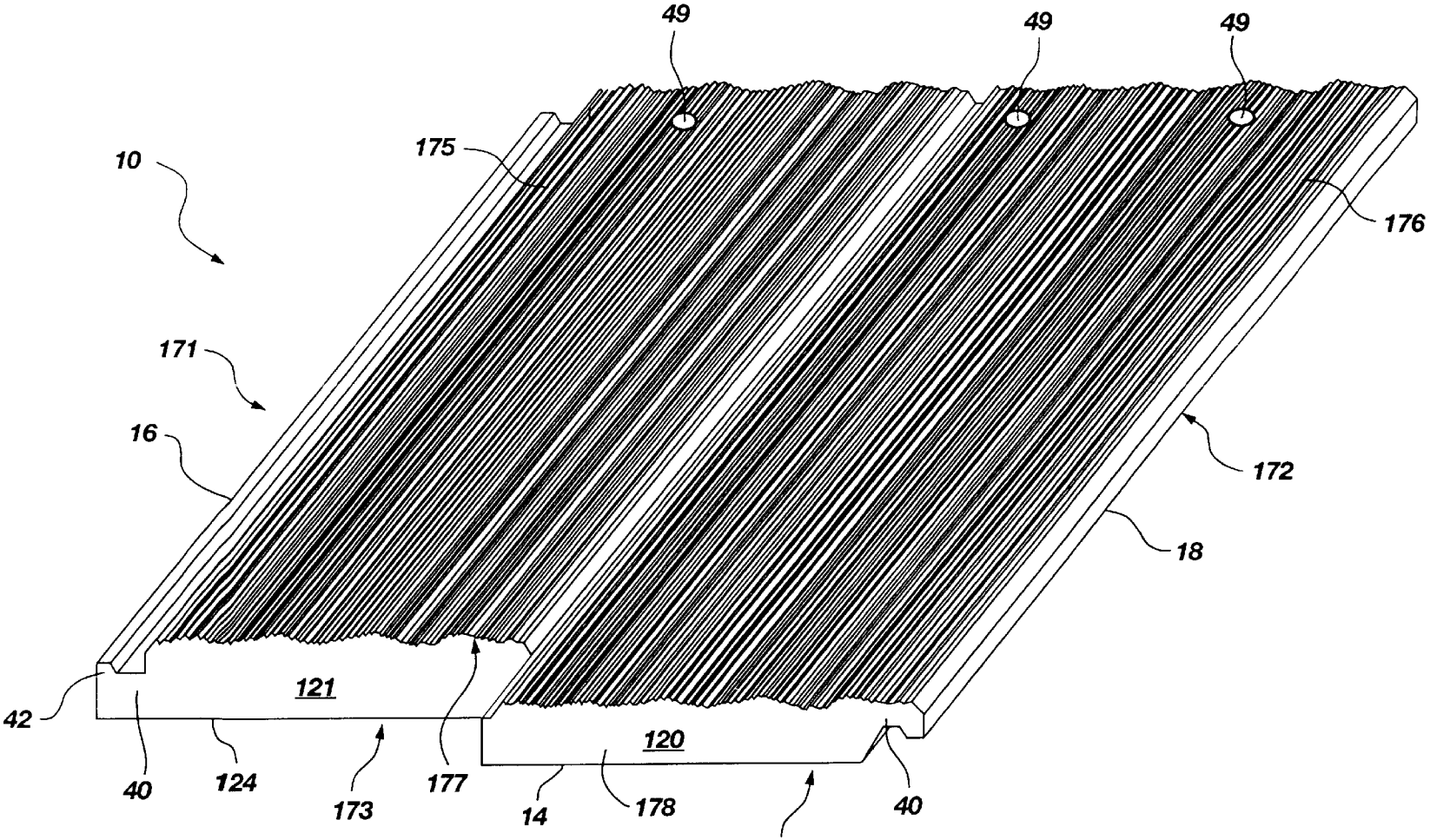
FIG. 7 is a top view of an alternative embodiment of a tile.

Referring to FIG. 7, a top view of an alternative tile 10 is shown and comprises a lapped panel 171 and a lapping panel 172. The lapped panel 171 and the lapping panel 172 have corresponding profiles 173, 174 and top surfaces 175, 176. The embodiment of FIG. 7 is similar to the embodiment of FIG. 4 except that the embodiment of FIG. 7 has an undulating structure 177 on the top surfaces 175, 176. The undulating structure 177 is similar to that of the undulating structure 157 of FIG. 5. The undulating structure 177 continues along the length of the overlap portion 178 of the lapping panel 172.

Figure 8:
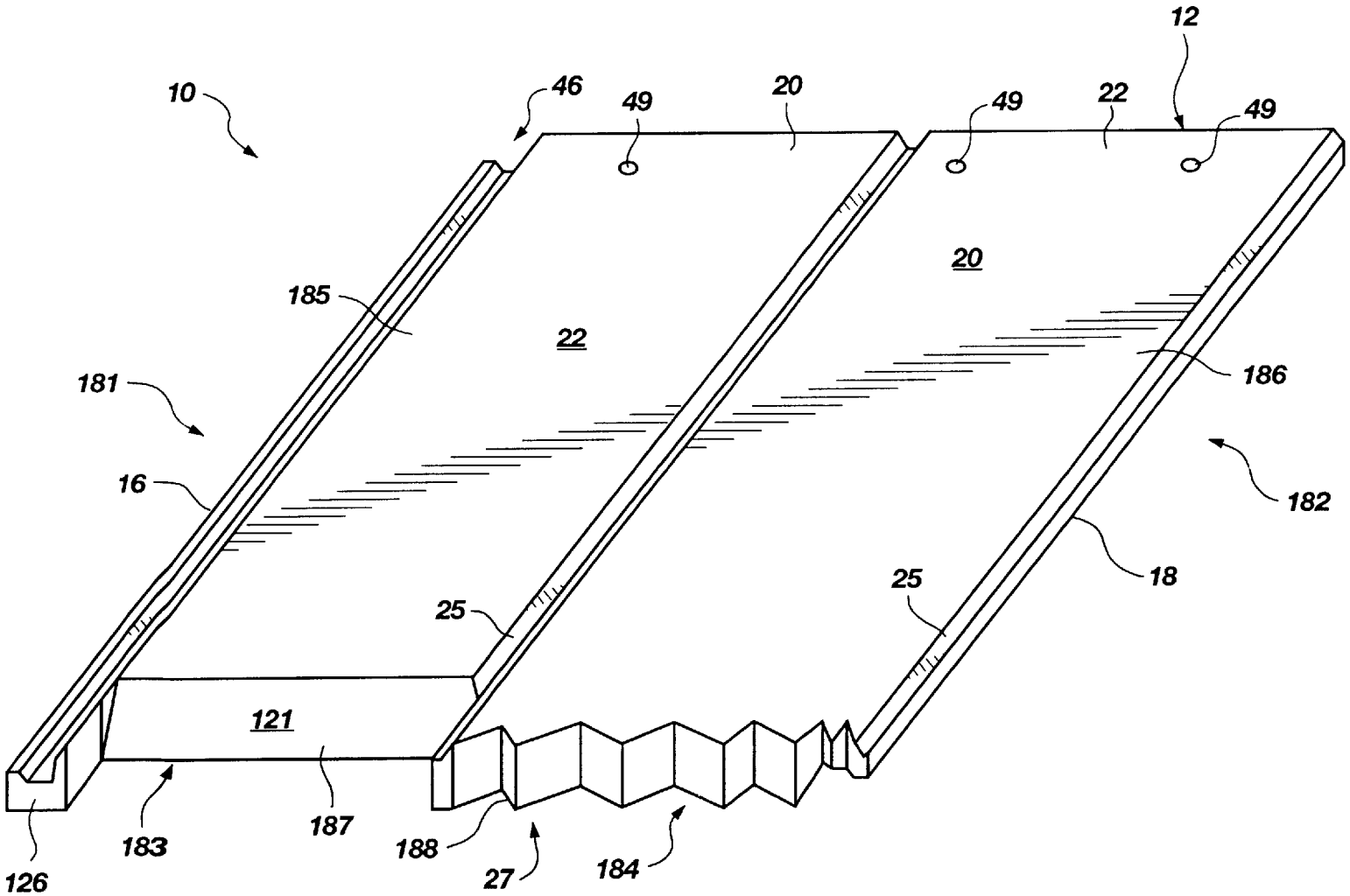
FIG. 8 is a top view of an alternative embodiment of a tile.

Referring to FIG. 8, a top view of an alternative tile 10 is shown and comprises a lapped panel 181 and a lapping panel 182. The lapped panel 181 and the lapping panel 182 have corresponding profiles 183, 184 and top surfaces 185, 186. The top surfaces 185, 186 may be characterized as flat or generally smooth in this embodiment. The embodiment of FIG. 8 is similar to the embodiment of FIG. 3 except that the embodiment of FIG. 8 has a beveled edge 187 on the lapped panel 181. Furthermore, the lapping panel 182 has a jagged, oblique edge 188.

Figure 9:
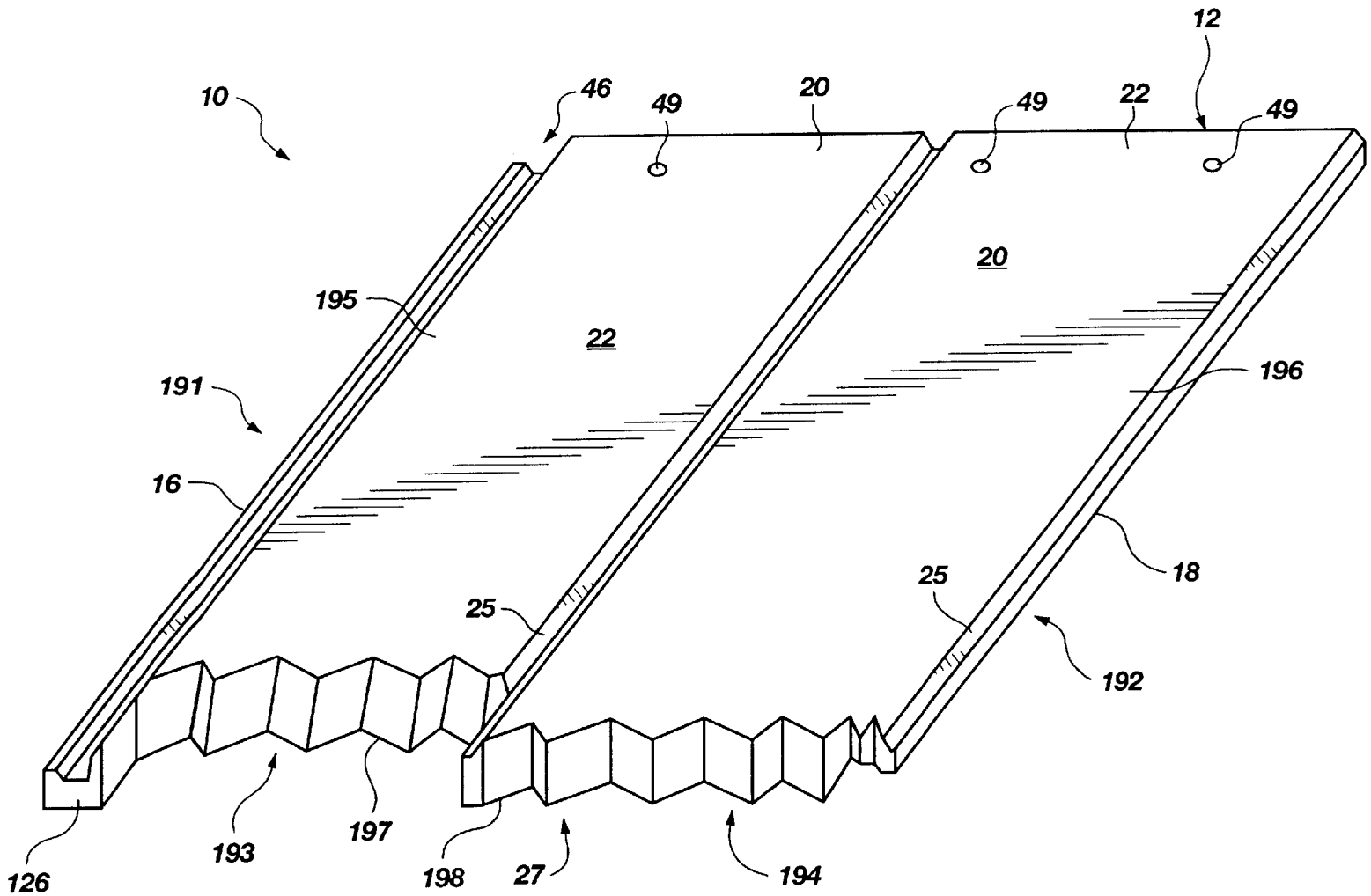
FIG. 9 is a top view of an alternative embodiment of a tile.

Referring to FIG. 9, a top view of an alternative tile 10 is shown and comprises a lapped panel 191 and a lapping panel 190. The lapped panel 191 and the lapping panel 192 have corresponding profiles 193, 194 and top surfaces 195, 196. The top surfaces 195, 196 may be characterized as flat or generally smooth in this embodiment. The embodiment of FIG. 9 is similar to the embodiment of FIG. 3 except that the panels 191, 192 have jagged, oblique edges 197, 198.

Figure 10:
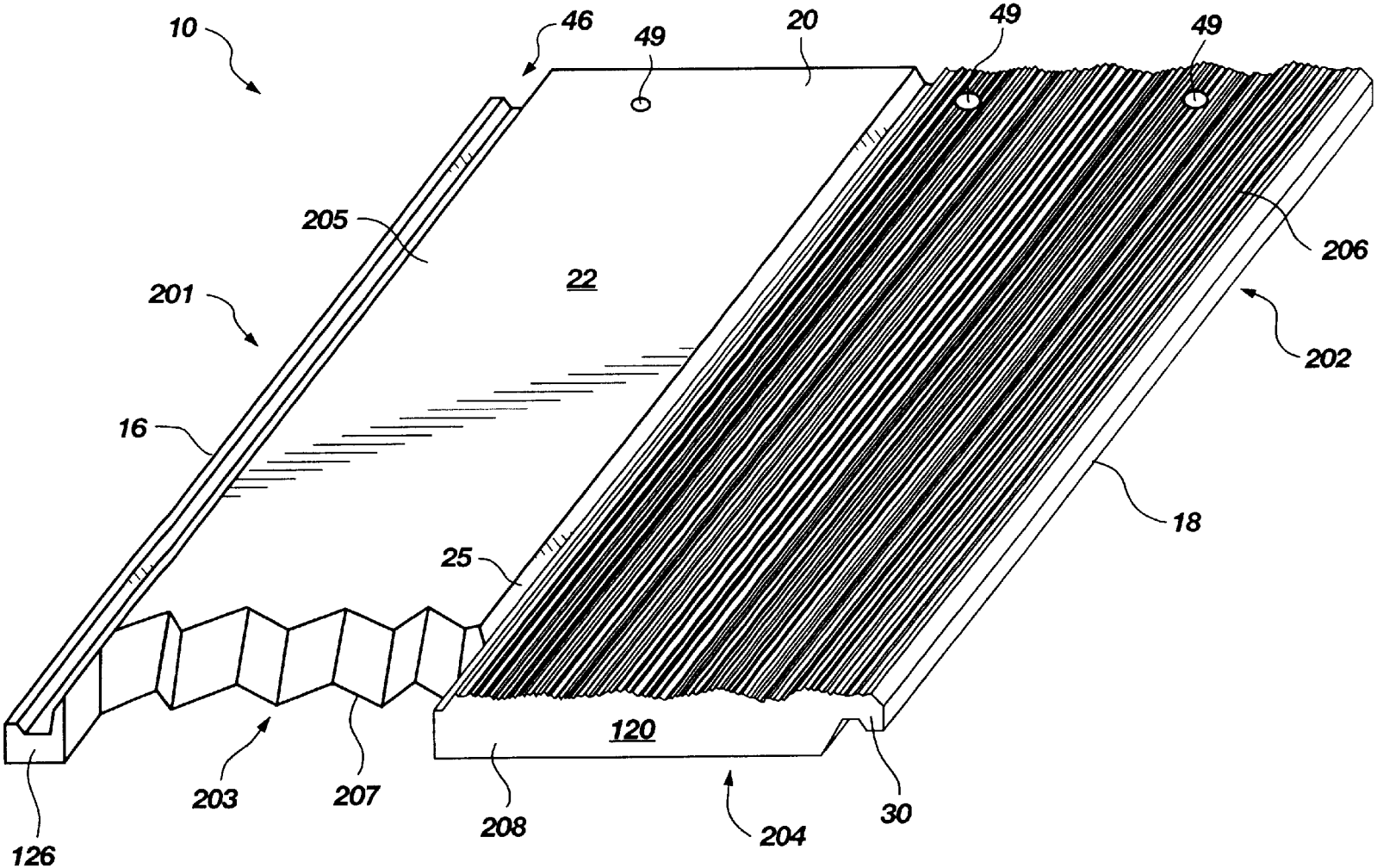
FIG. 10 is a top view of an alternative embodiment of a tile.

Referring to FIG. 10, a top view of an alternative tile 10 is shown and comprises a lapped panel 201 and a lapping panel 202. The lapped panel 201 and the lapping panel 202 have corresponding profiles 203, 204 and top surfaces 205, 206. The embodiment of FIG. 10 is similar to the embodiment of FIG. 3. One of the primary distinctions is that the lapped panel 201 has a jagged, oblique edge 207 as indicated. The overlap portion 208 of the lapping panel 202 has a generally straight edge. Furthermore, the top surface 205 may be characterized as flat or generally smooth whereas the top surface 206 has an undulating surface.

Figure 11:
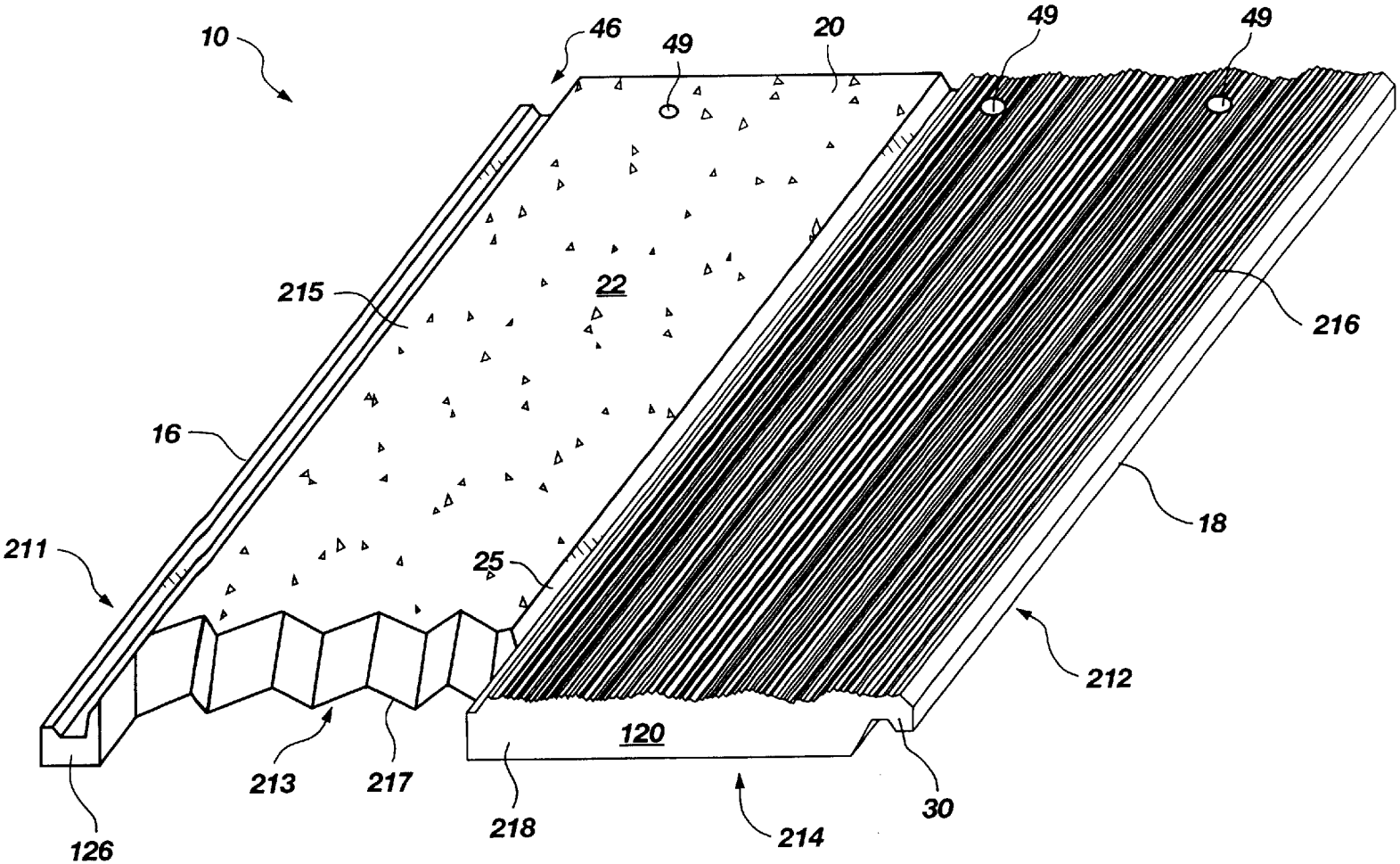
FIG. 11 is a top view of an alternative embodiment of a tile.

Referring to FIG. 11, a top view of an alternative tile 10 is shown and comprises a lapped panel 211 and a lapping panel 212. The lapped panel 211 and the lapping panel 212 have corresponding profiles 213, 214 and top surfaces 215, 216. The embodiment of FIG. 11 is similar to the embodiment of FIG. 3 in overall function. One distinction is that the lapped panel 211 has a jagged, oblique edge 217 as indicated. The overlap portion 218 of the lapping panel 212 has a generally straight edge. The top surface 215 may be characterized as a roughened surface and the top surface 216 has an undulating surface.

Figure 12:
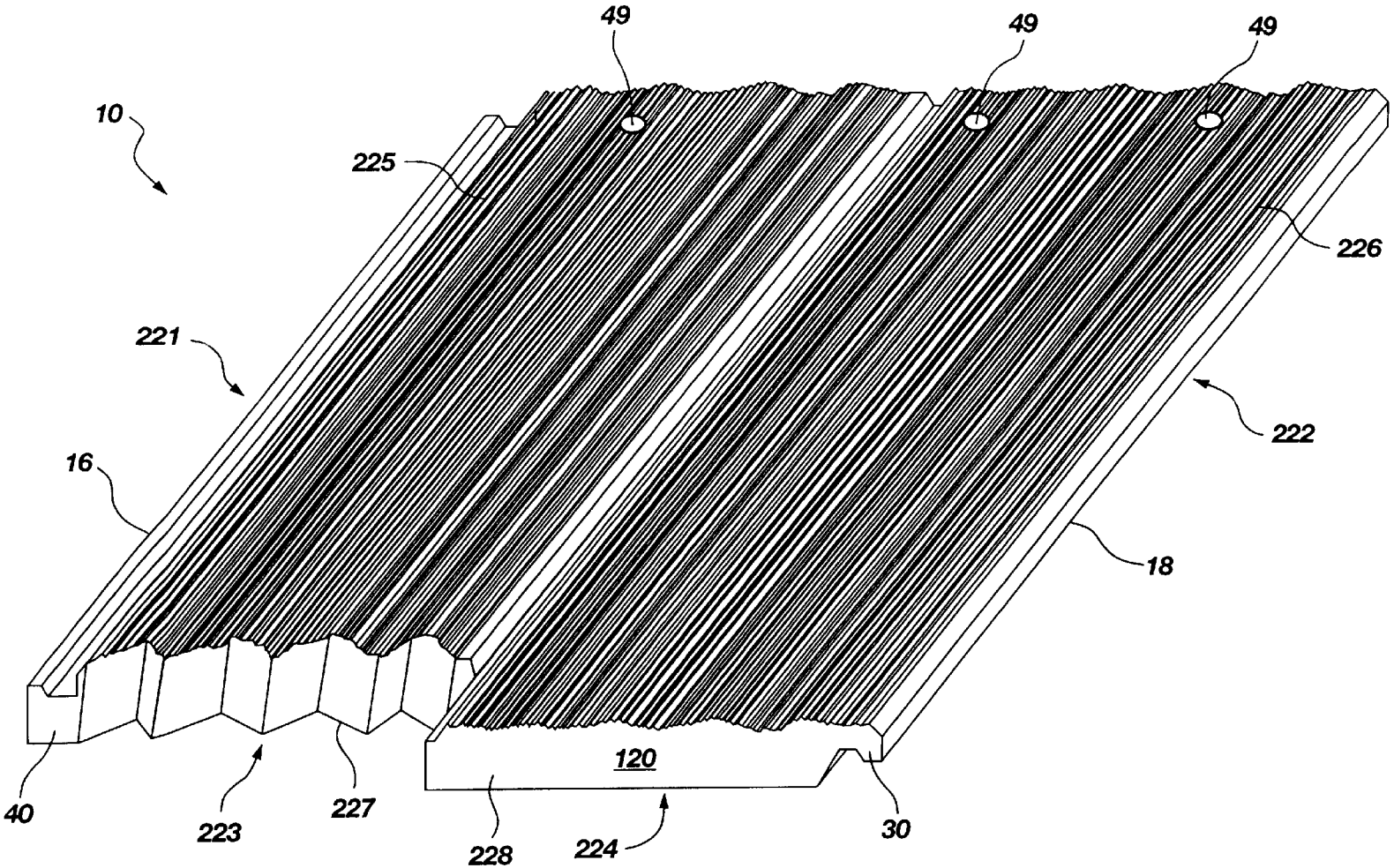
FIG. 12 is a top view of an alternative embodiment of a tile.

Referring to FIG. 12, a top view of an alternative tile 10 is shown and comprises a lapped panel 221 and a lapping panel 222. The lapped panel 221 and the lapping panel 222 have corresponding profiles 223, 224 and top surfaces 225, 226. The embodiment of FIG. 12 is similar to the embodiment of FIG. 4 in overall function. One distinction is that the lapped panel 221 has a jagged, oblique edge 227 as indicated. The overlap portion 228 of the lapping panel 222 has a generally straight edge. The top surfaces 225, 226 may be characterized as having an undulating surface.

Figure 13:
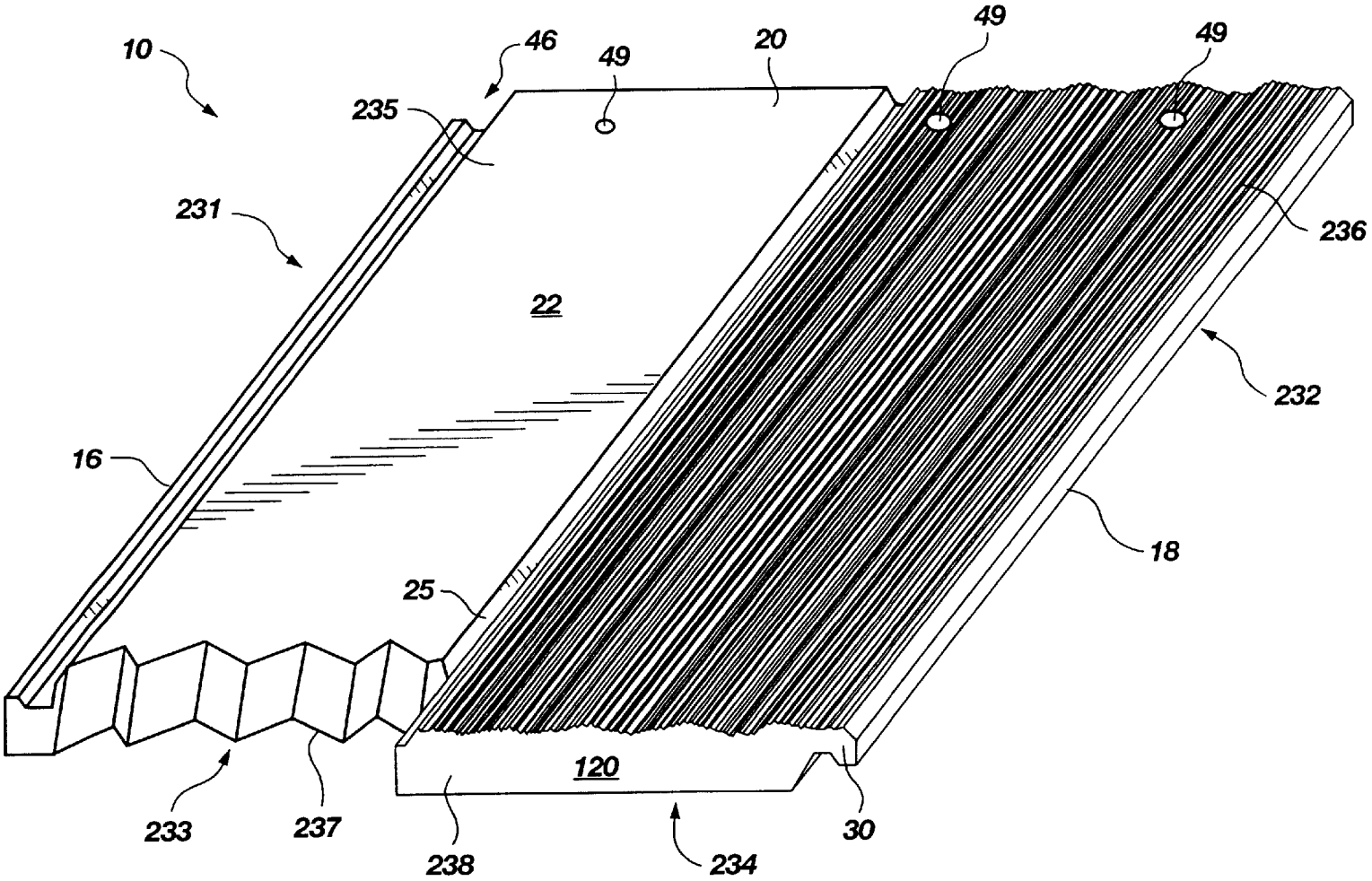
FIG. 13 is a top view of an alternative embodiment of a tile.

Referring to FIG. 13, a top view of an alternative tile 10 is shown and comprises a lapped panel 231 and a lapping panel 232. The lapped panel 231 and the lapping panel 232 have corresponding profiles 233, 234 and top surfaces 235, 236. The embodiment of FIG. 13 is similar to the embodiment of FIG. 4 in overall function. One distinction is that the lapped panel 231 has a jagged, oblique edge 237 as indicated. The overlap portion 238 of the lapping panel 232 has a generally straight edge. The top surface 235 has a generally smooth or flat surface and the top surface 236 has an undulating surface.

Figure 14:
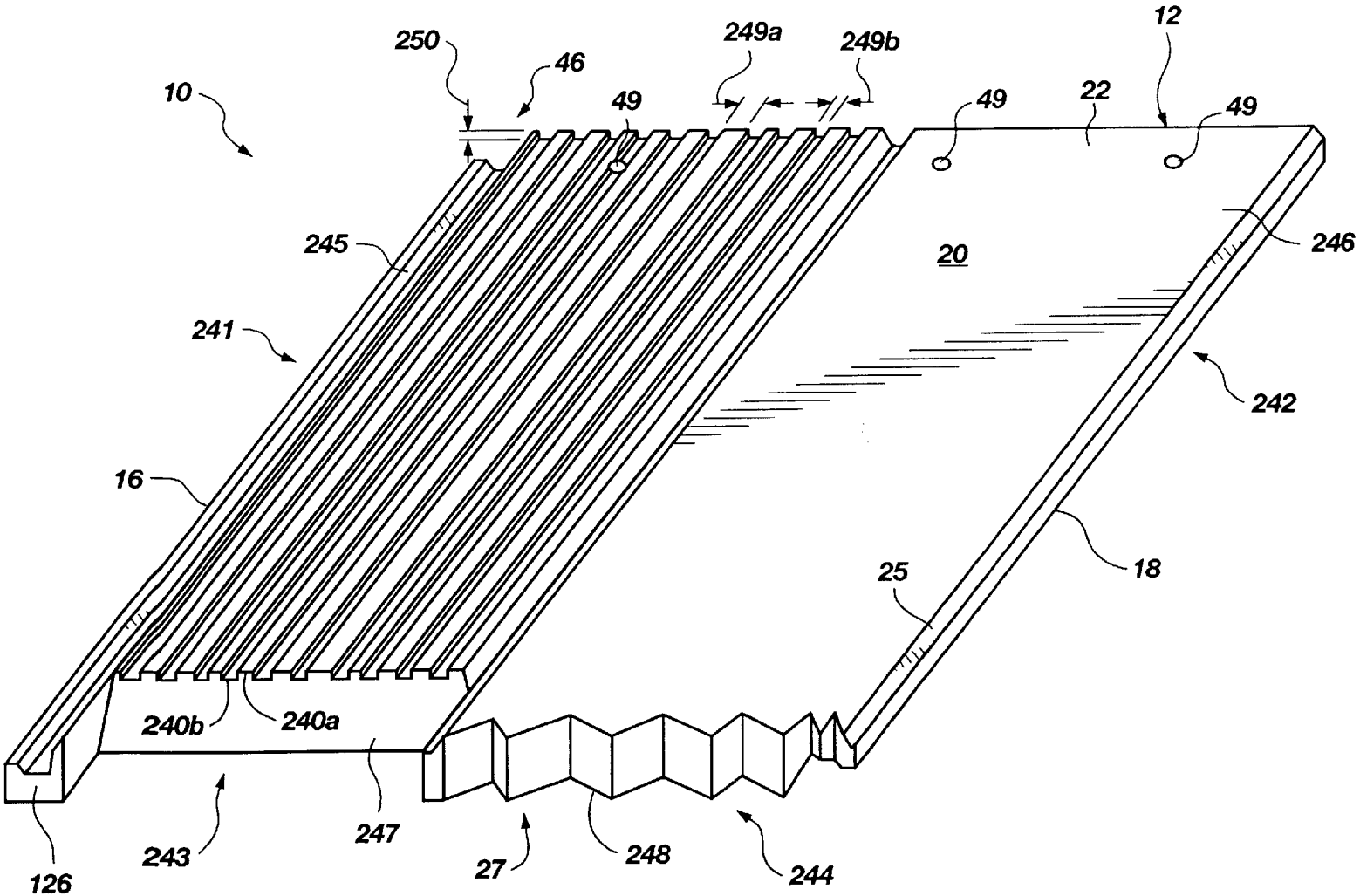
FIG. 14 is a top view of an alternative embodiment of a tile.

Referring to FIG. 14, a top view of an alternative tile 10 is shown and comprises a lapped panel 241 and a lapping panel 242. The lapped panel 241 and the lapping panel 242 have corresponding profiles 243, 244 and top surfaces 245, 246. The embodiment of FIG. 14 is similar to the embodiment of FIG. 3 in overall function. One distinction is that the overlap portion 248 of the lapping panel 242 has a jagged, oblique edge. A further distinction is that the top surface 245 is grooved and comprises a series of lands 240*a* and grooves 240*b* in an alternating fashion as illustrated. Each land 240*a* and groove 240*b* have corresponding widths 249*a*, 249*b*. The top surface 226 has a smooth or generally flat surface.

Figure 15:
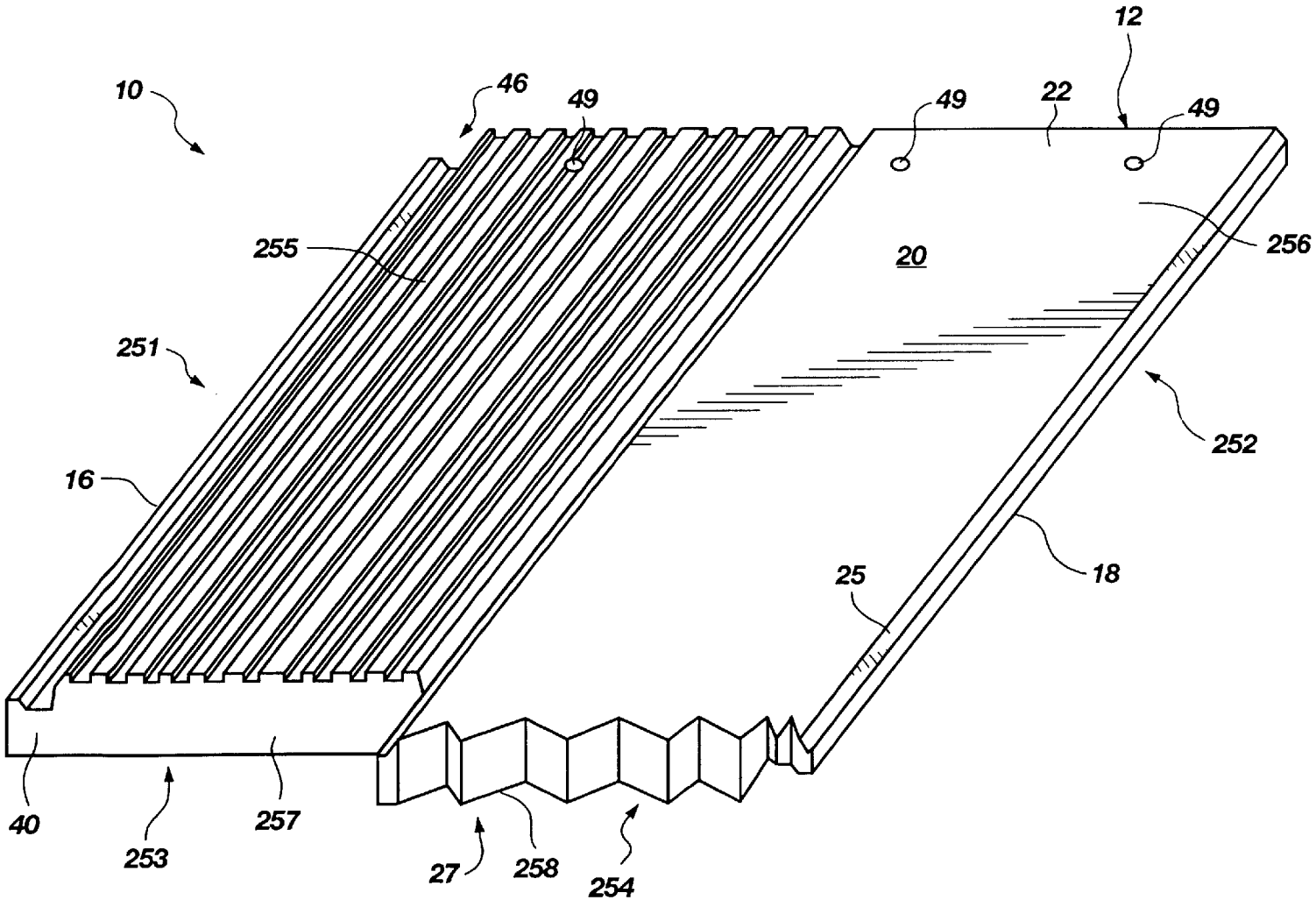
FIG. 15 is a top view of an alternative embodiment of a tile.

Referring to FIG. 15, a top view of an alternative tile 10 is shown and comprises a lapped panel 251 and a lapping panel 252. The lapped panel 251 and the lapping panel 252 have corresponding profiles 253, 254 and top surfaces 255, 256. The embodiment of FIG. 15 is similar to the embodiment of FIG. 4 in overall function. One distinction is that the overlap portion 258 of the lapping panel 252 has a jagged or oblique edge. The top surface 255 has a grooved surface and the top surface 256 has a smooth or generally flat surface.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A tile, comprising:

a panel having a top surface and bottom surface, spaced transversely a thickness apart, a head end and foot end spaced longitudinally apart, a first edge corresponding to a first side, and a second edge spaced laterally from the first edge and corresponding to a second side;

a first rib extending laterally across the bottom surface, proximate a center portion thereof, the rib being disposed to protrude transversely a depth from the bottom surface for increasing the bending strength of the panel and configured to stand away from an underlying support surface for providing a continuous flow of fluids thereunder;

a second rib extending longitudinally and continuously across the bottom surface, proximate a center portion thereof, the rib being disposed to protrude transversely a depth from the bottom surface for increasing the bending strength of the panel; and first and second sidelaps disposed proximate the first and second edges, respectively for engaging adjacent tiles in lapping relation.

2. The tile of claim 1, wherein the thickness and depth are selected to provide a bending strength greater than that of a portion of the panel lacking the rib and having the same average areal weight as the panel.

3. The tile of claim 2, wherein the first and second ribs extend across the bottom surface, angled with respect to the first side and the head end to increase the strength-to-weight ratio of the panel.

4. The tile of claim 3, wherein the rib and panel are homogeneous in lateral and transverse directions.

5. The tile of claim 1, wherein the first sidelap comprises a toe and the second sidelap comprises a finger, the toe and the finger configured for engaging, respectively, a finger of a first adjacent tile, and a toe of a second adjacent tile.

6. The tile of claim 5, wherein material is distributed in the tile to provide a finger thickness, corresponding to a transverse dimension of the finger, and a toe thickness, corresponding to a transverse dimension of the toe, each selected to be substantially equal to each other.

7. The tile of claim 5, wherein the panel comprises first and second sub-panels, configured with a divider therebetween, the first and second sub-panels having a first and second face, respectively, proximate the foot end.

8. The tile of claim 7, wherein the first sub-panel has a longitudinal length shorter than the second sub-panel, providing a setback, spacing the first face longitudinally from the second face.

9. The tile of claim 8, wherein the first sidelap corresponds to the first sub-panel and includes a spur extending longitudinally beyond the first face for engaging a sidelap of the first adjacent tile along the entire length thereof.

10. The tile of claim 1, wherein at least one second rib extends longitudinally, and further comprises a taper, proximate the head end, for providing substantially flat contact against a supporting surface.

11. The tile of claim 1 further comprising a lug formed on the rib, between the ends thereof, and extending transversely for contacting a supporting surface.

12. The tile of claim 1 further comprising a plurality of ribs.

13. The tile of claim 12, wherein the plurality of ribs includes longitudinal ribs extending in a longitudinal direction, and lateral ribs extending in a lateral direction.

14. The tile of claim 13, wherein the plurality of ribs is non-uniformly distributed about the bottom surface.

15. The tile of claim 13, wherein a first depth, corresponding to the longitudinal ribs, and a second depth, corresponding to the lateral ribs, are different.

16. The tile of claim 1, wherein at least one second rib extends longitudinally to form a first channel for passing fluid past the head end.

17. The tile of claim 16, positionable with respect to first and second longitudinally adjacent tiles, and wherein the first channel is formed to pass fluid along a supporting surface from a second channel corresponding to the first longitudinally adjacent tile, through the first channel, and into a third channel, corresponding to the second longitudinally adjacent tile.

18. The tile of claim 1, wherein the panel has a width extending laterally, a length extending longitudinally, and the rib is configured to provide a bending strength selected to support the tile at an aspect ratio, of the width to the length, equal to substantially unity.

19. The tile of claim 1, wherein the panel has a length, extending longitudinally, and further comprises a first sub-panel and second sub-panel, the first sub-panel having a first width extending laterally, and the second sub-panel having a second width extending laterally, and wherein aspect ratios of the first width to the length and of the second width to the length are substantially equal to each other and equal to a value of about one half.

20. A tile, comprising:

a panel having a top surface and bottom surface, spaced transversely a thickness apart, a head end and foot end spaced longitudinally apart, a first edge corresponding to a first side, and a second edge spaced laterally from the first edge and corresponding to a second side;

a rib extending across the bottom surface, proximate a center portion thereof, the rib being disposed to protrude transversely a depth from the bottom surface for increasing the bending strength of the panel;

first and second sidelaps disposed proximate the first and second edges, respectively for engaging adjacent tiles in lapping relation;

the first sidelap further comprising a toe and the second sidelap further comprising a finger, the toe and the finger configured for engaging, respectively, a finger of a first adjacent tile, and a toe of a second adjacent tile; and the panel further comprising first and second sub-panels, configured with a divider therebetween, the first and second sub-panels having a first and second face, respectively, proximate the foot end, the first sub-panel having a longitudinal length shorter than the second sub-panel, providing a setback, spacing the first face longitudinally from the second face.

21. The tile of claim 20, wherein the first sidelap corresponds to the first sub-panel and includes a spur extending longitudinally beyond the first face for engaging a sidelap of the first adjacent tile along the entire length thereof.

22. A tile, comprising:

a panel having a top surface and bottom surface, spaced transversely a thickness apart, a head end and foot end spaced longitudinally apart, a first edge corresponding to a first side, and a second edge spaced laterally from the first edge and corresponding to a second side;

a rib extending laterally across the bottom surface, proximate a center portion thereof, the rib being disposed to protrude transversely a depth from the bottom surface for increasing the bending strength of the panel and configured to stand away from an underlying support surface for providing a longitudinal channel to conduct a continuous flow of fluids thereunder; and first and second sidelaps disposed proximate the first and second edges, respectively for engaging adjacent tiles in lapping relation.

* * * * *